US007238465B2

(12) United States Patent
Ohshima

(10) Patent No.: US 7,238,465 B2
(45) Date of Patent: Jul. 3, 2007

(54) SILVER HALIDE COLOR PHOTOGRAPHIC PHOTOSENSITIVE MATERIAL AND IMAGE FORMING METHOD UTILIZING THE SAME

(75) Inventor: Naoto Ohshima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 111 days.

(21) Appl. No.: 10/823,700

(22) Filed: Apr. 14, 2004

(65) Prior Publication Data

US 2004/0197717 A1 Oct. 7, 2004

Related U.S. Application Data

(62) Division of application No. 10/401,893, filed on Mar. 31, 2003, now Pat. No. 6,777,174.

(30) Foreign Application Priority Data

Mar. 29, 2002 (JP) ..... 2002-96657

(51) Int. Cl.

| | |
|---|---|
| ***G03C 1/46*** | (2006.01) |
| ***G03C 1/08*** | (2006.01) |
| ***G03C 7/26*** | (2006.01) |
| ***G03C 1/005*** | (2006.01) |
| ***G03C 1/494*** | (2006.01) |

(52) U.S. Cl. ..... 430/502; 430/503; 430/567; 430/543; 430/383

(58) Field of Classification Search ..... 430/502, 430/503, 567, 543, 383
See application file for complete search history.

(56) References Cited

U.S. PATENT DOCUMENTS

| | | | | |
|---|---|---|---|---|
| 5,691,119 | A | 11/1997 | Mydlarz et al. | |
| 5,726,005 | A | 3/1998 | Chen et al. | |
| 5,736,310 | A | 4/1998 | Chen et al. | |
| 5,783,373 | A | 7/1998 | Mydlarz et al. | |
| 5,783,378 | A | 7/1998 | Mydlarz et al. | |
| 6,465,164 | B1 | 10/2002 | Aylward et al. | |
| 6,777,174 | B2 * | 8/2004 | Ohshima | 430/543 |
| 6,780,579 | B2 * | 8/2004 | Sasaki et al. | 430/603 |

FOREIGN PATENT DOCUMENTS

| | | | |
|---|---|---|---|
| EP | 0 928 988 | | 7/1999 |
| JP | 2000-171928 | A | 6/2000 |
| JP | 2000-221625 | A | 8/2000 |
| JP | 2000-250163 | A | 9/2000 |
| JP | 2000-352793 | A | 12/2000 |
| JP | 2001-100345 | A | 4/2001 |
| JP | 2001-324783 | A | 11/2001 |

* cited by examiner

*Primary Examiner*—Geraldina Visconti
(74) *Attorney, Agent, or Firm*—Sughrue Mion, PLLC

(57) ABSTRACT

The invention provides a silver halide color photographic photosensitive material including a substrate and photographic layers containing a yellow color-developing blue light-sensitive silver halide emulsion layer, a magenta color-developing green light-sensitive silver halide emulsion layer, a cyan color-developing red light-sensitive silver halide emulsion layer and a non-photosensitive hydrophilic colloid layer, wherein a total gelatin coating amount in the photographic layers is within a range from 3 to 6 g/m$^2$ and/or a total silver coating amount in the photographic layers is within a range from 0.2 to 0.5 g/m$^2$, the yellow color-developing blue light-sensitive silver halide emulsion layer includes a silver halide emulsion having silver halide grains which have a sphere-equivalent diameter of no more than 0.6 μm and a silver chloride content of at least 90 mol %, and an image forming method utilizing the photosensitive material.

11 Claims, No Drawings

SILVER HALIDE COLOR PHOTOGRAPHIC PHOTOSENSITIVE MATERIAL AND IMAGE FORMING METHOD UTILIZING THE SAME

CROSS REFERENCE TO RELATED APPLICATIONS

This is a divisional of application Ser. No. 10/401,893 filed Mar. 31, 2003 now U.S. Pat. No. 6,777,174; the disclosure of which is incorporated herein by reference.

BACKGROUND OF THE INVENTION

1. Field of the Invention

The present invention relates to a silver halide photographic photosensitive material and an image forming method utilizing the same, and more particularly to a silver halide photographic photosensitive material suitable for rapid processing, capable of showing rapid development progression and providing high-contrast gradation even in digital exposure such as laser-scan exposure, and an image forming method utilizing the same.

2. Description of the Related Art

Recently, digital technology has shown remarkable pervasiveness even in the field of color printing utilizing a color photographic paper, and, for example, a digital exposure method based on laser-scan exposure is showing a drastic increase in comparison with a prior analog exposure method in which a print is printed with a color printer from a developed color negative film. Such a digital exposure method has an advantage of obtaining high image quality by image processing, and therefore plays an extremely important role in improving the quality of the color print utilizing the color photographic paper. In view of the rapid spread of digital cameras, it is also an important factor for such a printing method that a high-quality color print can be easily obtained from electronic recording media of such (digital cameras, and these factors are anticipated to bring about a further expansion of such a printing method.

On the other hand, various other printing technologies such as ink jet recording, sublimation transfer recording and color electrophotography have shown progress and, being praised for photographic quality, are also recognized as color printing methods. Among these methods, the digital exposure method utilizing the color photographic paper is characterized by high image quality, high productivity and high image durability, and is desired to more simply and more inexpensively provide photographs of a higher quality by fully exploiting such characterisitics. The superiority of the color print utilizing the color photographic printing paper will be further enhanced by making it possible, after a recording medium of a digital camera is received at a shop, to prepare a high-quality print within a short time on the order of several minutes and deliver the print to the customer on the spot.

In the color photographic paper, in order to meet requirements for rapid development, a silver halide emulsion with a high content of silver chloride is employed. It is generally known that rapid developability can be further improved by employing a silver halide emulsion of a smaller grain size. However, it has been found that a reduction in grain size in an emulsion with a high silver chloride content tends to cause, particularly in high illumination intensity exposure such as laser-scan exposure, a variation in density resulting from a fluctuation in development factors in a gradation exposed area, thereby making it impossible to obtain the advantage of rapid developing in significant manner.

Iridium doping is known for improving reciprocity failure at a high illumination intensity in the silver chloride emulsion and obtaining a high contrast gradation even under a high illumination intensity. However the silver chloride emulsion doped with iridium is known to result in latent image sensitization within a short time after exposure, and, for example, Japanese Patent Application Publication (JP-B) No. 7-34013 discloses a method of avoiding latent image sensitization by forming a localized phase of a high silver bromide content and executing iridium doping therein. A silver halide emulsion prepared according to such a method shows a high sensitivity and a high contrast and is free from latent image sensitization even under exposure of a relatively high illumination intensity such as that of about 1/100 seconds, but it has been found difficult to obtain a high contrast gradation when attempting to maintain a high sensitivity to an ultra-high illumination intensity exposure of 1 microsecond which is required in the digital exposure method based on laser-scan exposure. U.S. Pat. No. 5,691,119 discloses a method of obtaining a high contrast gradation under a high illumination intensity in the preparation of an emulsion having a localized phase with a high silver bromide content, but such a method is not sufficiently effective and has a drawback in that performance is unstable in the repeated preparations.

U.S. Pat. Nos. 5,783,373 and 5,783,378 disclose methods of reducing reciprocity failure and obtaining a high contrast gradation by employing at least three dopants. However, a high contrast gradation is realized by the use of a dopant having a contrast increasing effect with a desensitizing effect, and is therefore incompatible in principle with obtaining a higher sensitivity.

U.S. Pat. Nos. 5,726,005 and 5,736,310 disclose obtaining a high sensitivity and a reduced reciprocity failure under a high illumination intensity by using an emulsion containing iodine with a density maximum at a sub-surface of the emulsion grains having high silver chloride content. Also, EP 0,928,988A discloses, in an example thereof, obtaining an emulsion having improved reciprocity failure, and superior temperature dependence and pressure resistance at exposure by including a specific compound in grains in which an I-band is formed at a point of 93% grain formation and which has a side length of 0.218 μm, i.e. a sphere-equivalent diameter of about 0.27 μm. However, though such a silver halide emulsion of a high silver chloride content having a small grain size as disclosed in these references certainly shows a high sensitivity under exposure at a higher illumination intensity, it has been found to show a quite low contrast gradation under an ultra-high illumination intensity exposure such as laser-scan exposure, thus being unsuitable for digital exposure which is limited in the dynamic range of the light amount, and also to have a drawback in that a latent image is poor in stability over a period of several seconds to several tens of seconds after exposure.

Japanese Patent Application Laid Open (JP-A) Nos. 58-95736, 58-108533, 60-222844, 60-222845, 62-253143, 62-253144, 62-253166, 62-254139, 63-46440, 63-46441 and 63-89840, and U.S. Pat. Nos. 4,820,624, 4,865,962, 5,399,475 and 5,284,743 disclose that a high sensitivity can be obtained by including a phase of a high silver bromide content in a localized manner, in various forms, in an emulsion of a high silver chloride content. However these references do not describe a contrast increasing effect under ultra-high illumination intensity exposure such as laser-scan exposure.

As explained in the foregoing, various technologies have been disclosed to rectify reciprocity failure under a high exposure intensity and to obtain a high contrast gradation in a high silver chloride emulsion, but such technologies have drawbacks. In particular, if a grain size of these emulsions is reduced in order to achieve ultra rapid developability, a fluctuation in density is often caused, particularly in high-intensity exposure such as laser-scan exposure, resulting from a fluctuation in process factors in a gradation exposed area.

SUMMARY OF THE INVENTION

The present invention intends to provide a silver halide photographic photosensitive material suitable for a rapid processing and capable of providing a rapid development progression and high contrast gradation even under digital exposure such as laser-scan exposure, and an image forming method utilizing the same.

The present inventors have found that a combination of a specific gelatin coating amount or a specific silver coating amount and small silver chloride grains provides a high contrast, and an improvement in density fluctuation resulting from fluctuation in process factors in a gradation exposed area, thereby making it possible to exploit the advantage of a rapid development, and have thus completed the present invention.

A first aspect of the invention provides a silver halide color photographic photosensitive material comprising a support and photographic layers including a yellow color-developing blue light-sensitive silver halide emulsion layer, a magenta color-developing green light-sensitive silver halide emulsion layer, a cyan color-developing red light-sensitive silver halide emulsion layer and a non-photosensitive hydrophilic colloid layer, wherein a total gelatin coating amount in said photographic layers is within a range from 3 to 6 g/m$^2$ and the yellow color-developing blue light-sensitive silver halide emulsion layer includes a silver halide emulsion having silver halide grains which have a sphere-equivalent diameter of no more than 0.6 μm and a silver chloride content of at least 90 mol %.

A second aspect of the invention provides a silver halide color photographic photosensitive material comprising a support and photographic layers including a yellow color-developing blue light-sensitive silver halide emulsion layer, a magenta color-developing green light-sensitive silver halide emulsion layer, a cyan color-developing red light-sensitive silver halide emulsion layer and a non-photosensitive hydrophilic colloid layer, wherein a total silver coating amount in the photographic layers is within a range from 0.2 to 0.5 g/m$^2$ and the yellow color-developing blue light-sensitive silver halide emulsion layer includes a silver halide emulsion having silver halide grains which have a sphere-equivalent diameter of no more than 0.6 μm and a silver chloride content of at least 90 mol %.

A third aspect of the invention provides a silver halide color photographic photosensitive material comprising a support and photographic layers including a yellow color-developing blue light-sensitive silver halide emulsion layer, a magenta color-developing green light-sensitive silver halide emulsion layer, a cyan color-developing red light-sensitive silver halide emulsion layer and a non-photosensitive hydrophilic colloid layer, wherein a total gelatin coating amount in the photographic layers is within a range from 3 to 6 g/m$^2$, a total silver coating amount in the photographic layers is within a range from 0.2 to 0.5 g/m$^2$ and the yellow color-developing blue light-sensitive silver halide emulsion layer includes a silver halide emulsion having silver halide grains which have a sphere-equivalent diameter of no more than 0.6 μm and a silver chloride content of at least 90 mol %.

A fourth aspect of the invention provides an image forming method comprising the steps of imagewise exposing the above-described silver halide color photographic photosensitive material to coherent light of a blue laser having a light emission wavelength within a range of 420 to 460 nm and then subjecting the photosensitive material to a color development process.

A fifth aspect of the invention provides an image forming method comprising the steps of imagewise exposing the above-described silver halide color photographic photosensitive material and then subjecting the photosensitive material to a color development process with a color developing time of 20 seconds or less.

A sixth aspect of the invention provides an image forming method comprising the steps of imagewise exposing the above-described silver halide color photographic photosensitive material to coherent light of a blue laser having a light emission wavelength within a range of 420 to 460 nm and then subjecting the photosensitive material to a color development process with a color developing time of 20 seconds or less.

DETAILED DESCRIPTION OF THE PREFERRED EMBODIMENTS

In the following, the present invention will be clarified in detail.

A silver halide color photographic photosensitive material (hereinafter also simply called "photosensitive material") of the present invention has a support and photographic layers including a yellow color-developing blue light-sensitive silver halide emulsion layer, a magenta color-developing green light-sensitive silver halide emulsion layer, a cyan color-developing red light-sensitive silver halide emulsion layer and a non-photosensitive hydrophilic colloid layer. Here, the above-mentioned photographic layers are provided with a specific gelatin coating amount or with a specific silver coating amount and the yellow color-developing blue light-sensitive silver halide emulsion layer includes a specific silver halide emulsion.

In the photosensitive material of the invention, the photographic layers preferably have a total gelatin coating amount within a range from 3 to 6 g/m$^2$, and more preferably 3 to 5 g/m$^2$. Also in order to meet the requirements for development progression, fixing bleachability and remaining color even in a case of ultra rapid processing, a total film thickness of the photographic layers is preferably within a range of 3 to 7.5 μm, and more preferably 3 to 6.5 μm. A dry film thickness can be measured by measuring a difference between a film thickness before a peeling of the dry film and a film thickness after a peeling of the dry film, or by observing cross-sections of the photosensitive material under an optical microscope or an electron microscope. In the invention, in order to achieve improvements in the development progression and the drying speed at the same time, a swelled film thickness is preferably within a range from 8 to 19 μm, and more preferably 9 to 18 μm. The swelled film thickness can be measured by immersing a dried photosensitive material in an aqueous solution kept at 35° C. and executing a dotting method in a sufficiently equilibrized swelled state. In the photosensitive material of the invention, a total silver coating amount of the photographic layers is preferably within a range of 0.2 to 0.5 g/m$^2$, and more preferably within a range of 0.2 to 0.45 g/m$^2$. In the photosensitive material of the invention, it is required that either of the total gelatin coating amount and the total silver coating amount in the photographic layers is within the aforementioned preferred range, and it is naturally best when both are within the preferred ranges.

Silver Halide Emulsion

In the following, there will be given a detailed explanation on the silver halide emulsion.

In the invention, an emulsion including silver halide grains having a specific sphere-equivalent diameter is employed, and, particularly, the silver halide grains contained in the yellow color-developing blue light-sensitive silver halide emulsion layer is required to have a sphere-equivalent diameter of no more than 0.6 μm (preferably from 0.2 to 0.6 μm), preferably no more than 0.5 μm and more preferably no more than 0.4 μm. On the other hand, the silver halide grains contained in the magenta color-developing green light-sensitive silver halide emulsion layer and for the cyan color-developing red light-sensitive silver halide emulsion layer is required to have a sphere-equivalent diameter of no more than 0.4 μm (preferably from 0.2 to 0.4 μm), preferably no more than 0.35 μm and more preferably no more than 0.3 μm. In the present specification, the sphere-equivalent diameter is represented by a diameter of a sphere having the same volume as that of individual grain. A grain having a sphere-equivalent diameter of 0.6 μm corresponds to a cubic grain having a side length of about 0.48 μm, a grain having a sphere-equivalent diameter of 0.5 μm corresponds to a cubic grain having a side length of about 0.40 μm, a grain having a sphere-equivalent diameter of 0.4 μm corresponds to a cubic grain having a side length of about 0.32 μm, a grain having a sphere-equivalent diameter of 0.35 μm corresponds to a cubic grain having a side length of about 0.28 μm, and a grain having a sphere-equivalent diameter of 0.3 μm corresponds to a cubic grain having a side length of about 0.24 μm. A shape of such grains is not particularly limited, but a cubic grain substantially having a {100} plane, a tetradecahedral crystal grain (which may have rounded apexes and may include higher order planes), an octahedral crystal grain or a tabular grain having a principal surface formed by a {100} or {111} plane and having an aspect ratio of 2 or higher is preferably. The aspect ratio is obtained by dividing a diameter of a circle corresponding to a projected area with a thickness of the grain. In the invention, silver halide grains are more preferably cubic grains or tetradecahedral grains.

An emulsion containing silver halide grains having a specific silver halide content is employed as the silver halide emulsion in the invention. In particular, the silver halide emulsion used in the yellow color-developing blue light-sensitive silver halide emulsion layer is required to have a silver chloride content of at least 90 mol %, and, in view of the rapid processability, a silver chloride content thereof is preferably at least 93 mol % and more preferably at least 95 mol %. In order to obtain a high contrast and increase the developing speed in a gradation area under a high illumination intensity exposure, a silver bromide content of the silver halide grains is preferably 0.1 to 7 mol %, and more preferably 0.5 to 5 mol %. Also, in order to obtain a high contrast and increase the developing speed in a gradation area under a high illumination intensity exposure, a silver iodide content of the silver halide grains is preferably 0.02 to 1 mol %, more preferably 0.05 to 0.50 mol %, and most preferably 0.07 to 0.40 mol %. In particular, the silver halide grains in the silver halide emulsion for the yellow color-developing blue light-sensitive silver halide emulsion layer are preferably silver iodobromochloride grains, and more preferably silver iodobromochloride grains having the above-mentioned halogen composition.

On the other hand, the silver halide grains contained in the magenta color-developing green light-sensitive silver halide emulsion layer and in the cyan color-developing red light-sensitive silver halide emulsion layer also preferably have a similar silver halide content.

The silver halide grains in the silver halide emulsion employed in the invention preferably have a silver bromide-containing phase and/or a silver iodide-containing phase. The silver bromide-containing phase or the silver iodide-containing phase means a portion in which the concentration of silver bromide or silver iodide is higher than in a surrounding area. The halogen composition may change in a gradual manner or in a steep manner between the silver bromide-containing phase or the silver iodide-containing phase and the surrounding area. Such a silver bromide or silver iodide containing phase may be formed as a layer having a certain thickness and a substantially constant concentration in a part of the grains, or as a maximum point which does not have a thickness. The silver bromide-containing phase preferably has a local silver bromide content of at least 5 mol %, more preferably 10 to 80 mol % and most preferably 15 to 50 mol %. Also, the silver iodide-containing phase preferably has a local silver iodide content of at least 0.3 mol %, more preferably 0.5 to 8 mol % and most preferably 1 to 5 mol %. A plurality of such silver bromide- or silver iodide-containing phases may be present in a laminar manner within the grains. In this case, the silver bromide content or the silver iodide content of each phase may be respectively different.

In the silver halide emulsion to be employed in the invention, it is important that the silver bromide-containing phase or the silver iodide-containing phase is so formed in a laminar manner as to surround the grains. In a preferred embodiment, the silver-bromide containing phase or the silver iodide-containing phase, formed in a laminar manner so as to surround the grains, has a uniform concentration distribution in each phase in the circumferential direction of the grains. However, the silver-bromide containing phase or the silver iodide-containing phase, formed in a laminar manner so as to surround the grains, may include a maximum point or a minimum point in the concentration of silver bromide or silver iodide in the circumferential direction of the grains, thereby having a concentration distribution. For example, in the case where the silver bromide-containing phase or the silver iodide-containing phase is formed in a laminar manner so as to surround the grains in a vicinity of a surface of the grains, the concentration of silver bromide or silver iodide at a corner or an edge of the grains may become different from that in a principal surface of the grains. Also, in addition to the silver bromide-containing phase or the silver iodide-containing phase formed in a laminar manner so as to surround the grains, another silver bromide- or silver iodide-containing phase which is present in a completely isolated manner in a specific portion of the surface of the grains and which does not surround the grains may be provided.

In the case where the silver halide emulsion to be employed in the invention includes a silver bromide-containing phase, such a silver bromide-containing phase is preferably formed in a laminar manner so as to have a maximum in the concentration of silver bromide in the interior of the grains. Also, in the case where the silver halide emulsion employed in the invention includes a silver iodide-containing phase, such a silver iodide-containing phase is preferably formed in a laminar manner so as to have a maximum in the concentration of silver iodide on the surface of the grains. A silver amount of such a silver bromide- or silver iodide-containing phase is preferably within a range from 3 to 30% of the grain volume, and more preferably within a range from 3 to 15% in view of increasing the local concentration with a small amount of silver bromide or silver iodide.

The silver halide emulsion to be employed in the invention preferably includes both of the silver bromide-containing phase and the silver iodide-containing phase. In such a case, the silver bromide-containing phase and the silver iodide-containing phase may be present in the same location or in different locations in grains, but are preferably present in different locations in order to facilitate control of grain formation. It is also possible that the silver bromide-containing phase contains silver iodide or that the silver iodide-containing phase contains silver bromide. In general, an iodide added in the course of formation of grains having a high silver chloride content more easily seeps to the grain surface than a bromide, so that the silver iodide-containing phase tends to be formed in a vicinity of the grain surface. Therefore, in the case where the silver bromide-containing phase and the silver iodide-containing phase are present in different locations in grains, the silver bromide-containing phase is preferably formed more inside than the silver iodide-containing phase. In such a case, it is also possible to form another silver bromide-containing phase at the outside of the silver iodide-containing phase present in the vicinity of the grain surface.

A silver bromide content or a silver iodide content required for exhibiting the effects of the present invention such as high sensitivity or high contrast becomes larger as the silver bromide-containing phase or the silver iodide-containing phase is formed deeper in the grain, thereby lowering the silver chloride content more than necessary and deteriorating the rapid processability. Therefore, in order to concentrate these functions controlling the photographic actions at portions in the vicinity of the grain surface, the silver bromide-containing phase and the silver iodide-containing phase preferably adjoin. In consideration of these factors, it is preferable to form the silver bromide-containing phase in a position within a range of 50 to 100% of the grain volume, measured from the inside thereof, and to form the silver iodide-containing phase in a position within a range of 85 to 100% of the grain volume, and more preferable to form the silver bromide-containing phase in a position within a range of 70 to 95% of the grain volume and to form the silver iodide-containing phase in a position within a range of 90 to 100% of the grain volume.

Bromide ions or iodide ions for including silver bromide or silver iodide in the silver halide emulsion of the invention may be introduced by adding a solution of a bromide salt or an iodide salt singly, or by adding a solution of a bromide salt or an iodide salt in combination with addition of a silver salt solution and a salt solution having a high chloride content. In the latter case, the bromide salt solution or iodide salt solution and the salt solution having a high chloride content may be added separately or as a mixed solution. The bromide salt or iodide salt is added in a form of a soluble salt, such as a bromide salt or an iodide salt of an alkali metal or an alkaline earth metal. Otherwise, it is also possible to introduce bromide ions or iodide ions by cleaving an organic compound described in U.S. Pat. No. 5,389,508. Fine silver bromide grains or fine silver iodide grains may also be utilized as another source of bromide or iodide ions.

The solution of the bromide salt or iodide salt may be added intensively in the grain formation, or over a certain period. The introduction position of the iodide ions into the emulsion having a high chloride content is restricted in obtaining an emulsion having a high sensitivity and a low fog level. An increase in the sensitivity becomes smaller when the iodide ions are introduced in a more internal portion of the emulsion grains. Therefore, the iodide salt solution is preferably added to a position outer from 50% of the grain volume, more preferably outer from 70% of the grain volume and most preferably outer from 85% of the grain volume. Also, the addition of the iodide salt solution is preferably terminated at a position inner from 98% of the grain volume, and more preferably inner from 96% of the grain volume. The addition of the iodide salt solution, terminated in a position slightly inside the grain surface, can provide an emulsion having a high sensitivity and a low fog level.

On the other hand, the bromide salt solution is preferably added to a position outer from 50% of the grain volume, and more preferably outer from 70% of the grain volume.

The distribution of the bromide or iodide ion concentration in a direction of depth in the grains can be measured by an etching/TOF-SIMS method (time of flight-secondary ion mass spectrometry), for example with a TRIFT II Model TOF-SIMS manufactured by Phi Evans Inc. The TOF-SIMS method is specifically described in *Hyomen Bunseki Gijutsu Sensho Niji Ion Shitsuryo Bunsekiho*, edited by Japanese Society of Surface Science and published by Maruzen Co. (1999). An analysis of emulsion grains with the etching/TOF-SIMS method shows that the iodide ions seep toward the grain surface even in the case where the addition of the iodide salt solution is terminated at an inside position of the grains. In the emulsion used in the invention, it is preferable that, in the analysis by the etching/TOF-SIMS method, the concentration of iodide ions has a maximum at the grain surface and gradually decreases toward the interior of the grains, and that the concentration of bromide ions has a maximum in the interior of the grains. The local concentration of silver bromide can also be measured by X-ray diffractometry in the case where the content of silver bromide is at a certain high level.

The silver halide emulsion to be employed in the invention preferably has grains whose grain size distribution is monodisperse. In the invention, a variation factor of the sphere-equivalent diameter of all the grains has to be 20% or less, and is preferably 15% or less and more preferably 10% or less. The variation factor of the sphere-equivalent diameter is represented by a percentage of a standard deviation of the sphere-equivalent diameter of each grain to the average sphere-equivalent diameter. Also, for a purpose of obtaining a wide latitude, it is advantageous to use the above-mentioned monodisperse emulsions in the blended state in a same layer or in superposed coated layers.

The silver halide emulsion to be employed in the invention may include silver halide grains other than the silver halide grains contained in the silver halide emulsion defined in the invention (namely specific silver halide grains). However, in the silver halide emulsion defined in the present invention, the silver halide grains defined in the invention have to occupy 50% or higher of all the projected area of all the grains, and preferably occupies 80% or higher and more preferably 90% or higher.

The specific silver halide grain in the silver halide emulsion used in the invention preferably includes iridium. A 6-coordination complex having 6 ligands and having iridium as a central metal (6-ligand iridium complex) is preferable as an iridium compound in order to be contained uniformly in the silver halide crystal. A 6-coordination complex having Ir as the central metal and having Cl, Br or I as at least one of ligands is preferable as a preferred embodiment of iridium to be employed in the invention, and a 6-coordination complex which has Ir as the central metal and in which all the six ligands are Cl, Br and/or I atoms is more preferable. In such a case, Cl, Br and I may be present in mixed manner in the 6-coordination complex. The 6-coordination complex having Ir as the central metal and having Cl, Br and/or I as at least one of the ligands is particularly preferably contained in the silver bromide-containing phase for the purpose of obtaining a high contrast gradation under a high illumination intensity exposure.

Examples of 6-coordination complex having Ir as the central metal and having Cl, Br and/or I in all the six ligands include the following compounds, but the iridium compound in the invention is not limited to such examples:

$[IrCl_6]^{2-}$
$[IrCl_6]^{3-}$
$[IrBr_6]^{2-}$
$[IrBr_6]^{3-}$
$[IrI_6]^{3-}$

A 6-coordination complex having Ir as the central metal and having at least one ligand other than halogen and cyano is preferable as another preferred embodiment of iridium compound in the invention, and a 6-coordination complex having Ir as the central metal and having $H_2O$, OH, O, OCN, thiazol or a substituted thiazol as at least one of ligands is preferable, and a 6-coordination complex having Ir as the central metal and having $H_2O$, OH, O, OCN, thiazole and/or a substituted thiazole as at least one of ligands, and having Cl, Br and/or I as the remaining ligands is more preferable. A 6-coordination complex having Ir as the central metal and having one or two 5-methylthiazole as a ligand or ligands, and having Cl, Br and/or I as the remaining ligands is the most preferable.

Examples of the 6-coordination complex having Ir as the central metal and having $H_2O$, OH, O, OCN, thiazol and/or a substituted thiazol as at least one of ligands, and having Cl, Br or I as the remaining ligands include the following compounds, but the iridium compound in the invention is not limited to such examples:

$[Ir(H_2O)Cl_5]^{2-}$
$[Ir(H_2O)_2Cl_4]^{-}$
$[Ir(H_2O)Br_5]^{2-}$
$[Ir(H_2O)_2Br_4]^{-}$
$[Ir(OH)Cl_5]^{3-}$
$[Ir(OH)_2Cl_4]^{3-}$
$[Ir(OH)Br_5]^{3-}$
$[Ir(OH)_2Br_4]^{3-}$
$[Ir(O)Cl_5]^{4-}$
$[Ir(O)_2Cl_4]^{5-}$
$[Ir(O)Br_5]^{4-}$
$[Ir(O)_2Br_4]^{5-}$
$[Ir(OCN)Cl_5]^{3-}$
$[Ir(OCN)Br_5]^{3-}$
$[Ir(thiazole)Cl_5]^{2-}$
$[Ir(thiazole)_2Cl_4]^{-}$
$[Ir(thiazole)Br_5]^{2-}$
$[Ir(thiazole)_2Br_4]^{-}$
$[Ir(5\text{-methylthiazole})Cl_5]^{2-}$
$[Ir(5\text{-methylthiazole})_2Cl_4]^{-}$
$[Ir(5\text{-methylthiazole})Br_5]^{2-}$
$[Ir(5\text{-methylthiazole})_2Br_4]^{-}$.

Objects of the invention are preferably attained by singly employing either of a 6-coordination complex having ft as the central metal and Cl, Br or I as all of 6 ligands or a 6-coordination complex having Ir as the central metal and having at least one ligand other than halogen and cyano. However, in order to further enhance the effects of the invention, it is preferable to use a 6-coordination complex having Ir as the central metal and Cl, Br or I as all of 6 ligands and a 6-coordination complex having Ir as the central metal and having at least one ligand other than halogen and cyano in combination. Further, the 6-coordination complex having Ir as the central metal and having $H_2O$, OH, O, OCN, thiazole and/or a substituted thiazole as at least one of ligands, and Cl, Br or I as the remaining ligands is preferably a complex having two types of ligands (one type from $H_2O$, OH, O, OCN, thiazole and a substituted thiazole and one type from Cl, Br and I).

The metal complexes mentioned in the foregoing is an anion, and, in the case where it forms a salt with a cation, a counter cation easily soluble in water is preferably employed. Specific examples thereof include an alkali metal ion such as sodium ion, potassium ion, rubidium ion, cesium ion and lithium ion, an ammonium ion and an alkylammonium ion. Such a metal complex can be used in the form of a solution obtained by dissolving it in water or in a mixed solvent of water and a suitable water-miscible organic solvent (for example an alcohol, an ether, a glycol, a ketone, an ester or an amide). Such an iridium complex is preferably added in an amount of $1\times10^{-10}$ to $1\times10^{-3}$ moles and more preferably $1\times10^{-8}$ to $1\times10^{-5}$ moles per mole of silver in the course of forming grains.

In the invention, the above-mentioned iridium complex is preferably incorporated in the silver halide grains by directly adding it to a reaction solution at the time of the formation of the silver halide grains or by adding it to an aqueous halide solution for forming the silver halide grains or to another solution and adding the resultant solution to the reaction solution for grain formation. It is also preferable to execute physical ripening with fine particles incorporating the iridium complex in advance and then to in corporate the fine particles into the silver halide grains. It is furthermore possible to combine these methods so as to incorporate the iridium complex into the silver halide grains.

When such a complex is incoporated into the silver halide grains, it may be uniformly distributed in the interior of the grains, but it is preferable, as disclosed in JP-A Nos. 4-208936, 2-125245 and 3-188437, to distribute the complex only in a surfacial layer of the grains, or to distribute the complex only in the interior of the grains and to add a complex-free layer on the surface of the grains. It is also preferable, as disclosed in U.S. Pat. Nos. 5,252,451 and 5,256,530, to execute physical ripening with fine particles incorporating the complex, thereby modifying the surfacial phase of the grains. It is also possible to use these methods in combination, or to incorporate plural complexes into a silver halide grains. The halogen composition is not particularly limited in a position where the aforementioned complex is incorporated, but the 6-coordination complex having Ir as the central metal and Cl, Br or I as all of six ligands is preferably incorporated in a position where silver bromide concentration is maximum.

In the invention, a metal ion other than iridium may be doped in the interior and/or on the surface of the silver halide grains. The metal ion to be employed is preferably a transition metal ion. Preferable examples thereof include iron, ruthenium, osmium, lead, cadmium and zinc. Such a metal ion is more preferably employed in the form of a 6-coordination octahedral complex. In the case where an inorganic compound is employed as a ligand, specific examples thereof include a cyanide ion, a halide ion, thiocyan, a hydroxide ion, a peroxide ion, an azide ion, a nitrite ion, water, ammonia, a nitrosyl ion, and a thionitrosyl ion. It is also preferable to form a coordination to an ion of the aforementioned metal such as iron, ruthenium, osmium, lead, cadmium and zinc with the inorganic compound, and it is also preferable to employ plural kinds of ligands within a complex molecule. It is also possible to employ an organic compound as a ligand, and a preferred organic compound can be a chain compound having 5 or less carbon atoms in a main chain and/or a 5-membered or 6-membered heterocyclic compound. A more preferred organic compound is a compound including a nitrogen atom, a phosphor atom, an oxygen atom or a sulfur atom in a molecule as a ligand atom to a metal. Furan, thiophene, oxazole, isooxazole, thiazole, isothiazole, imidazole, pyrazole, triazole, furazane, pyrane, pyridine, pyridazine, pyrimidine, or pyrazine is particularly preferable, and compounds obtained by introducing a substituent into a basic skeleton of these compounds are also preferable.

A preferred combination of a metal ion and a ligand is a combination of an iron ion, a ruthenium ion and a cyanide ion. In the invention, it is preferable to employ iridium and these compounds in combination. In such compound, the total cooridination number of the cyanide ions preferably is more than half of the total coordination number to iron or ruthenium constituting the central metal, and remaining coordination sites are preferably occupied by thiocyan, ammonia, water, nitrosyl ion, dimethylsulfoxide, pyridine, pyrazine or 4,4'-bipyridine. Most preferably, all the six coordination sites of the central metal are occupied by cyanide ions to form a hexacyanoiron complex or a hexacyanoruthenium complex. Such a complex having cyanide ions as ligands is preferably added, during the grain formation, in an amount of $1\times10^{-8}$ to $1\times10^{-2}$ moles per mole of silver, and most preferably $1\times10^{-6}$ to $5\times10^{-4}$ moles. In the case where ruthenium or osmium is used as the central metal, it is preferable to employ a nitrosyl ion, a thionitrosyl ion or a water molecule and a chloride ion as a ligand. It is more preferable to form a pentachloronitroxyl complex, a pentachlorothionitrosyl complex or a pentachloro aqua complex, and it is also preferable to form a hexachloro complex. Such a complex is preferably added, during the grain formation, in an amount of $1\times10^{-10}$ to $1\times10^{-6}$ moles per mole of silver, and more preferably $1\times10^{-9}$ to $1\times10^{-6}$ moles.

The silver halide emulsion to be employed in the invention is normally subjected to chemical sensitization. Sulfur sensitization represented by an addition of an unstable sulfur compound, precious metal sensitization represented by gold sensitization and reduction sensitization may be employed alone or in combination as chemical sensitization. A compound described in JP-A No. 62-215272, lower right column in page 18 to upper right column in page 22 is preferably employed in chemical sensitization. Among these, gold sensitization is particularly preferable, since gold sensitization can further reduce the variation of photographic performances under scan exposure with a laser beam or the like.

Any inorganic gold compound, a gold (I) complex having an inorganic ligand or a gold (I) compound having an organic ligand may be utilized in gold sensitization of the silver halide emulsion used in the invention. Chloroautic acid or a salt thereof may be employed as the inorganic gold compound, and a gold dithiocyanate compound such as gold (I) potassium dithiocyanate, and a gold dithiosulfate such as gold (I) trisodium dithiosulfate may be employed as the gold (I) complex having the inorganic ligand.

The silver halide emulsion to be employed in the invention is preferably gold-sensitized with colloidal gold sulfide or a gold sensitizer having a gold complex stability constant $\log\beta_2$ of from 21 to 35. A method for producing colloidal gold sulfide is described for example in *Research Disclosure* 37154, *Solid State Ionics*, vol.79, pp. 60-66 (1995) and *Compt. Rend. Hebt. Seances Acad. Sci. Sect., B*263, p. 1328 (1966). Any size of the colloidal gold sulfide can be used, and that having a particle size of 50 nm or less can also be employed. The amount therof may vary within a wide range, but is usually within a range of $5\times10^{-7}$ to $5\times10^{-3}$ moles of gold atoms per mole of silver halide, and preferably $5\times10^{-6}$ to $5\times10^{-4}$ moles. In the invention, the gold sensitization may be combined with another sensitization such as sulfur sensitization, selenium sensitization, tellurium sensitization, reduction sensitization or precious metal sensitization utilizing a compound other than gold compound.

The gold sensitizer having a gold complex stability constant $\log\beta2$ of from 21 to 35 will be explained hereinafter.

The gold complex stability constant $\log\beta_2$ can be determined on the basis of measuring methods described in *Comprehensive Coordination Chemistry*, Chap. 55, p. 864 (1987), *Encyclopedia of Electrochemistry of the Elements*, Chap. IV-3 (1975), *Journal of the Royal Netherlands Chemical Society*, Vol. 101, p. 164 (1982) and references therein, and is obtained from the gold potential under the following conditions: a measuring temperature of 25° C.; a pH value of 6.0 which is adjusted with an addition of a dihydrogen potassium phosphate/hydrogen disodium phosphate buffer; and an ionic strength of 0.1 M (KBr). A stability constant $\log\beta_2$ of a thiocyanate ion measured by these measuring methods is 20.5, which is close to a value 20 described in a reference *Comprehensive Coordination Chemistry*, Chap. 55, p. 864, Table 2 (1987).

In the invention, the gold sensitizer having a gold complex stability constant $\log\beta_2$ within a range of 21 to 35 is preferably represented by a following general formula (I):

$$\{(L^1)_x(Au)_y(L^2)_z\cdot Q_q\}_p \qquad \text{General formula (I):}$$

wherein $L^1$ and $L^2$ independently represent a compound having a $\log\beta_2$ of from 21 to 35, preferably from 22 to 31 and more preferably from 24 to 28.

$L^1$ and $L^2$, which may be the same or different, independently represent a compound including at least one unstable sulfur-containing group capable of generating silver sulfide by reacting with silver halide, a hydantoin compound, a thioether compound, a mesoionic compound, —SR', a heterocyclic compound, a phosphine compound, an amino acid derivative, a sugar derivative, or a thiocyano group. R' represents an aliphatic hydrocarbon group, an aryl group, a heterocyclic group, an acyl group, a carbamoyl group, a thiocarbamoyl group or a sulfonyl group.

Q represents a counter anion or a counter cation required for neutralizing the charge of the compound; x and z independently represent an integer from 0 to 4; y and p independently represent 1 or 2; and q represents a value including a fraction within a range of 0 to 1; wherein x and z are not both 0 at the same time.

Preferably, in the compound represented by the general formula (I), $L^1$ and $L^2$ independently represent a compound including at least one unstable sulfur-containing group capable of generating silver sulfide by reacting with silver halide, a hydantoin compound, a thioether compound, a mesoionic compound, —SR', a heterocyclic compound, or a phosphine compound, and x, y and z independently represent 1.

More preferably, in the compound represented by the general formula (I), $L^1$ and $L^2$ independently represent a compound including at least one unstable sulfur-containing group capable of generating silver sulfide by reacting with silver halide, a mesoionic compound, or —SR', and x, y, z and p independently represent 1.

The gold compound represented by the general formula (I) will be explained in more detail hereinafter.

In the general formula (I), the compound represented by $L^1$ and $L^2$ and including an unstable sulfur-containing group capable of generating silver sulfide by reacting with silver halide is a thioketone (such as a thiourea, a thioamide, or rhodanine), thiophosphate, or a thiosulfuric acid.

The compound including at least one unstable sulfur-containing group capable of generating silver sulfide by reacting with silver halide is preferably a thioketone (preferably a thiourea or a thioamide), or a thiosulfiric acid.

In the general formula (I), for example, the hydantoin compound represented by $L^1$ and $L^2$ can be unsubstituted hydantoin or N-methylhydantoin; the thioether compound can be a chain or cyclic thioether having 1 to 8 thio groups which are connected by a substituted or unsubstituted, linear or branched alkylene group (such as ethylene or triethylene) or by a phenylene group (for example, bishydroxyethyl thioether, 3,6-dithia-1,8-octanediol or 1,4,8,11-tetrathiacyclotetradecane); and the mesoionic compound can be, for example, a mesoionic-3-mercapto-1,2,4-triazole (such as mesoionic-1,4,5-trimethyl-3-mercapto-1,2,4-triazole).

In the general formula (I), in the case where $L^1$ and $L^2$ represent —SR', the aliphatic hydrocarbon group represented by R' can be a substituted or unsubstituted, linear or branched alkyl group with 1 to 30 carbon atoms (such as methyl, ethyl, isopropyl, n-propyl, n-butyl, t-butyl, 2-pentyl, n-hexyl, n-octyl, t-octyl, 2-ethylhexyl, 1,5-dimethylhexyl, n-decyl, n-dodecyl, n-tetradecyl, n-hexadecyl, hydroxyethyl, hydroxypropyl, 2,3-dihydroxypropyl, carboxymethyl, carboxyethyl, sodium sulfoethyl, diethylaminoethyl, diethylaminopropyl, butoxypropyl, ethoxyethoxyethyl, and n-hexyloxypropyl), a substituted or unsubstituted cyclic alkyl group with 3 to 18 carbon atoms (such as cyclopropyl, cyclopentyl, cyclohexyl, cyclooctyl, adamantyl, and cyclododecyl), an alkenyl group with 2 to 16 carbon atoms (such as allyl, 2-butenyl, and 3-pentenyl), an alkynyl group with 2 to 10 carbon atoms (such as propargyl, and 3-pentynyl), or an aralkyl group with 6 to 16 carbon atoms (such as benzyl); the aryl group can be a substituted or unsubstituted phenyl or naphthyl group with 6 to 20 carbon atoms (such as unsubstituted phenyl, unsubstituted naphthyl, 3,5-dimethylphenyl, 4-butoxyphenyl, 4-dimethylaminophenyl and 2-carboxyphenyl); the heterocyclic group can be, for example, a substituted or unsubstituted 5-membered nitrogen-containing heterocyclic group (such as imidazolyl, 1,2,4-triazolyl, tetrazolyl, oxadiazolyl, thiadiazolyl, benzoimidazolyl, and purinyl), a substituted or unsubstituted 6-membered nitrogen-containing heterocyclic group (such as pyridyl, piperidyl, 1,3,5-triazino, and 4,6-dimercapto-1,3,5-triazino), a furyl group or a thienyl group; the acyl group can be, for example, acetyl or benzoyl; the carbamoyl group can be, for example, dimethylcarbamoyl; the thiocarbamoyl group can be, for example, diethylthiocarbamoyl; and the sulfonyl group can be, for example, a substituted or unsubstituted alkylsulfonyl group with 1 to 10 carbon atoms (such as methanesulfonyl and ethanesulfonyl), or a substituted or unsubstituted phenylsulfonyl group with 6 to 16 carbon atoms (such as phenylsulfonyl).

In —SR' represented by $L^1$ and $L^2$, R' is preferably an aryl group or a heterocyclic group, more preferably a heterocyclic group, further preferably a 5- or 6-membered nitrogen-containing heterocyclic group, and most preferably a nitrogen-containing heterocyclic group substituted with a water-soluble group (such as sulfo, carboxy, hydroxy or amino).

In the general formula (I), the heterocyclic compound represented by $L^1$ and $L^2$ can be a 5-membered nitrogen-containing substituted or unsubstituted heterocyclic compound (for example a pyrole, a imidazole, a pyrazole, a 1,2,3-triazole, a 1,2,4-triazole, a tetrazole, an oxazole, an isooxazole, an isothazole, an oxadiazole, a thiadiazole, a pyrrolidine, a pyrroline, an imidazolidine, an imidazoline, a pyrazolidine, a pyradoline, or a hydantoin), a heterocyclic compound including such a 5-membered ring (such as an indole, an isoindole, an indolizine, an indazole, a benzoimidazole, a purin, a benzotriazole, a carbazol, a tetrazaindene, a benzothiazole and an indoline), a 6-membered nitrogen-containing substituted or unsubstituted heterocyclic group (such as a pyridine, a pyrazine, a pyrimidine, a pyridazine, a triazine, a thiadiazine, a piperidine, a piperazine, and a morpholine), a heterocyclic compound including such a 6-membered ring (such as a quinoline, an isoquinoline, a phthalazine, a naphthyridine, a quinoxaline, a quinazoline, a pteridine, a phenathridine, an acrylidine, phenanthroline, and phenadine), a substituted or unsubstituted furan, a substituted or unsubstituted thiophene, or a benzothiazolium.

The heterocyclic compound represented by $L^1$ and $L^2$ is preferably an unsaturated 5- or 6-membered nitrogen-containing heterocyclic compound or a heterocyclic compound including such a compound, such as a pyrole, an imidazole, a pyrazole, a 1,2,4-triazole, an oxadiazole, a thiadiazole, an imidazoline, an indole, an indolizine, an indazole, a benzoimidazole, a purin, a benzotriazole, a carbazol, a tetrazaindene, a benzothiazole a pyridine, a pyrazine, a pyrimidine, a pyridazine, a triazine, a quinoline, an isoquinoline, and phthalazine, and a heterocyclic compound known as an antifoggant in the related field (such as an indazole, a benzoimidazole, a benzotriazole, or tetrazaindene) is further preferable.

In the general formula (I), the phosphine compound represented by $L^1$ and $L^2$ can be a phosphine substituted with an aliphatic hydrocarbon group having 1 to 30 carbon atoms, an aryl group having 6 to 20 carbon atoms, a heterocyclic group (for example, pyridyl), a substituted or unsubstituted amino group (for example, dimethylamino) and/or an alkyloxy group (for example, methyloxy or ethyloxy), and is preferably a phosphine substituted with an alkyl group having 1 to 10 carbon atoms or an aryl group having 6 to 12 carbon atoms (for example, triphenylphosphine or triethylphosphine).

Also, the mesoionic compound, —SR' and heterocyclic compound represented by $L^1$ and $L^2$ are preferably substituted with an unstable sulfur group capable of generating silver sulfide by reacting with silver halide (for example, thioureido group).

Further, the compound represented by $L^1$ and $L^2$ in the general formula (I) may have any other substituent, and examples of such a substituent include a halogen atom (such as a fluorine atom, a chlorine atom and a bromine atom), an aliphatic hydrocarbon group (such as methyl, ethyl, isopropyl, n-propyl, t-butyl, n-octyl, cyclopentyl, and cyclohexyl), an alkenyl group (such as allyl, 2-butenyl, and 3-pentenyl), an alkynyl group (such as propargyl, and 3-pentynyl), an aralkyl group (such as benzyl and phenethyl ) an aryl group (such as phenyl, naphthyl and 4-methylphenyl), a heterocyclic group (such as pyridyl, furyl, imidazolyl, piperidinyl and morphoryl), an alkyloxy group (such as methoxy, ethoxy, butoxy, 2-ethylhexyloxy, ethoxyethoxy, and methoxyethoxy), an aryloxy group (such as phenoxy and 2-naphthyloxy), an amino group (such as unsubstituted amino, dimethylamino, diethylamino, dipropylamino, dibutylamino, ethylamino, dibenzylamino, and anilino), an acylamino group (such as acetylamino and benzoylamino), an ureido group (such as unsubstituted ureido, N-methylureido and N-phenylureido), a thioureido group (such as unsubstituted thioureido, N-methylthioureido, and N-phenylthioureido), a selenoureido group (such as unsubstituted selenoureido), a phosphine selenide group (such as diphenylphosphine selenide), a telluroureido group (such as unsubstituted telluroureido), an urethane group (such as methoxycarbonylamino and phenoxycarbonylamino), a sulfonamide group (such as methylsulfonamide and phenylsulfonamide), a sulfamoyl group (such as unsubstituted sulfamoyl, N,N-dimethylsulfamoyl and N-phenylsulfamoyl), a carbamoyl group (such as unsubstituted carbamoyl, N,N-diethylcarbamoyl and N-phenylcarbamoyl), a sulfonyl group (such as methanesulfonyl and p-toluenesulfonyl), a sulfinyl group (such as methylsulfinyl and phenylsulfinyl), an alkyloxycarbonyl group (such as methoxycarbonyl and ethoxycarbonyl), an aryloxycarbonyl group (such as phenoxycarbonyl), an acyl group (such as acetyl, benzoyl, formyl and pivaloyl), an acyloxy group (such as acetoxy and benzoyloxy), a phosphoric acid amide group (such as N,N-diethylphosphoric acid amide), an alkylthio group (such as methylthio and ethylthio), an arylthio group (such as phenylthio), a cyano group, a sulfo group, a thiosulfonate group, a sulfinate group, a carboxy group, a hydroxy group, a mercapto group, a phosphono group, a nitro group, a sulfino group, an ammonio group (such as trimethylammonio), a phosphonio group, a hydrazino group, a thiazolino group, and a silyloxy group (such as t-butyldimethylsilyloxy and t-butyldiphenylsilyloxy). In the case where two or more substituents are present, they may be the same or different.

Q and q in the general formula (I) will be explained hereinafter.

In the general formula (I), examples of the counter anion represented by Q include a halogenium ion (such as $F^-$, $Cl^-$, Br or $I^-$), a tetrafluoroborate ion ($BF_4^-$), a hexaf luorophosphate ion ($PF_6^-$), a sulfate ion ($SO_4^{2-}$), an arylsulfonate ion (such as p-toluenesulfonate ion, and naphthalene-2,5-disulfonate ion), and a carboxy ion (such as acetate ion, trifluoroacetate ion, an oxalate ion and a benzoate ion), and examples of the counter cation represented by Q include an alkali metal ion (such as lithium ion, sodium ion, potassium ion, rubidium ion and cesium ion), an alkaline earth metal ion (such as magnesium ion and calcium ion), a substituted or unsubstituted ammonium ion (such as unsubstituted ammonium ion, triethylammonium and tetramethylammonium), a substituted or unsubstituted pyridinium ion (such as unsubstituted pyridinium ion, and 4-phenylpyridinium ion), and a proton. A number q is the number of the group Q for neutralizing the charge of the compound, and represents a value from 0 to 1 and can also be a decimal.

The counter anion represented by Q is preferably a halogenium ion (such as $Cl^-$ and $Br^-$), a tetrafluoroborate ion, a hexafluorophosphate ion or a sulfate ion, and the counter cation represented by Q is preferably an alkali metal ion (such as sodium ion, potassium ion, rubidium ion and cesium ion), a substituted or unsubstituted ammonium ion (such as unsubstituted ammonium ion, triethylammonium and tetramethylammonium) or a proton.

Specific examples (L-1 to L-17) of the compound represented by $L^1$ or $L^2$ include the following compounds, but the present invention is not limited to such examples. In these examples, a parenthesized number indicates a value of $\log\beta_2$.

(L-1)

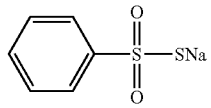

(22)

(L-2)

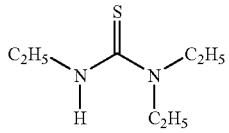

(24)

(L-3)

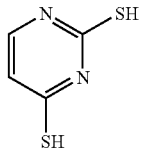

(25)

(L-4)

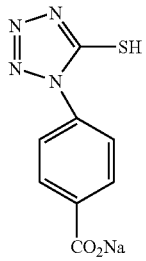

(25)

(L-5)

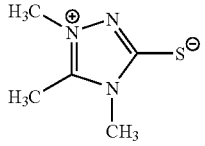

(26)

(L-6)

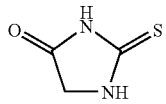

(27)

(L-7)

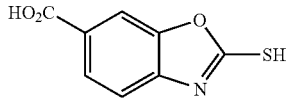

(27)

(L-8)

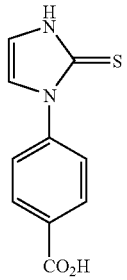

(27)

-continued (L-9)

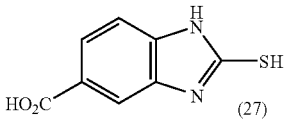

(27)

(L-10)

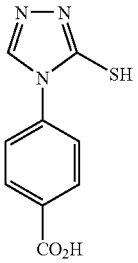

(27)

(L-11)

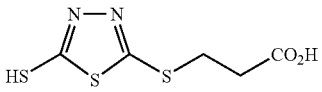

(27)

(L-12)

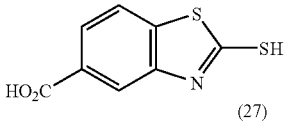

(27)

(L-13)

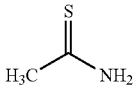

(28)

(L-14)

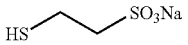

(28)

(L-15)

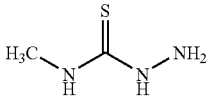

(29)

(L-16)

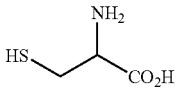

(29)

(L-17)

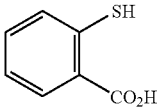

(30)

The compound represented by the general formula (I) can be synthesized by known methods such as those disclosed in *Inorg. Nucl. Chem. Letters*, Vol. 10, p. 641 (1974), *Transition Met. Chem.*, p. 1,248 (1976), *Acta Cryst.* B32, p. 3321 (1976), JP-A No. 8-69075, JP-B No. 45-8831, European Patent No. 915371A1, JP-A Nos. 6-11788, 6-501789, 4-267249 and 9-118685.

Specific example (S-1 to S-19) of the compound represented by the general formula (I) include the following compounds, but the present invention is not limited to such examples.

(S-1)

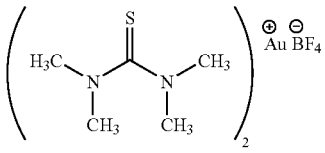

(S-2)

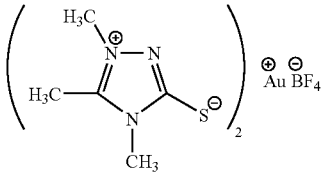

(S-3)

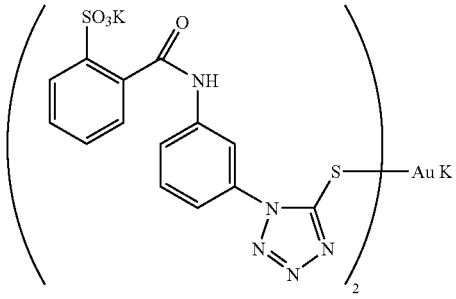

(S-4)

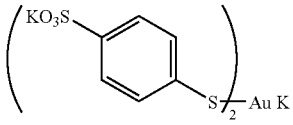

(S-5)

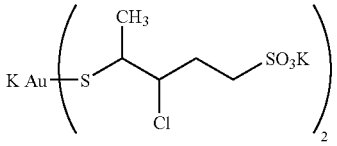

(S-6)

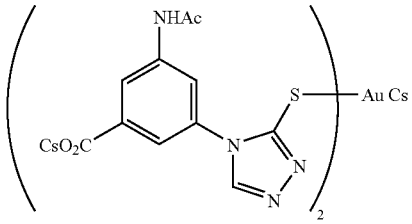

(S-7)

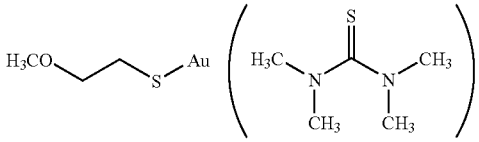

(S-8)

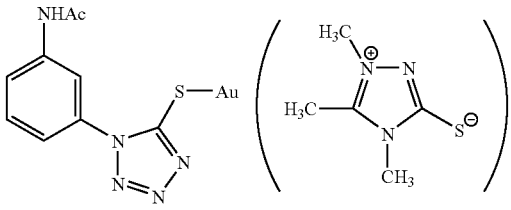

-continued (S-9)

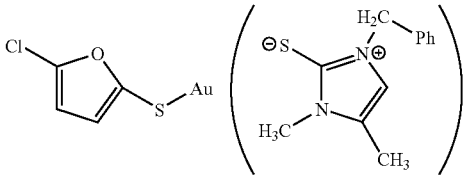

(S-10)

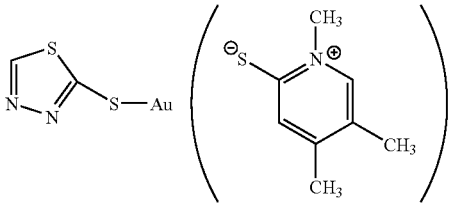

(S-11)

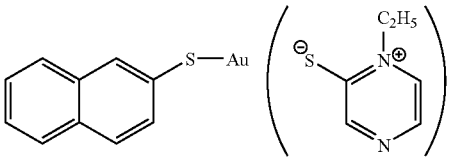

(S-12)

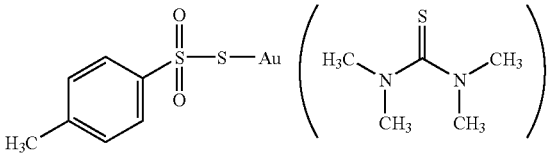

(S-13)

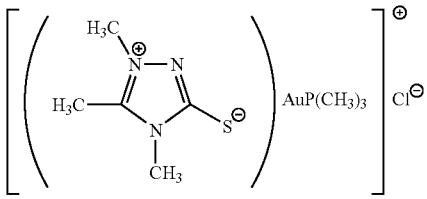

(S-14)

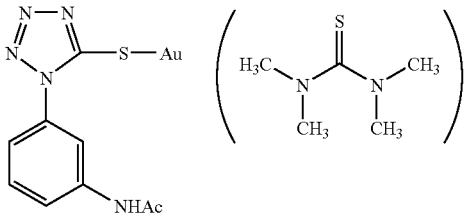

(S-15)

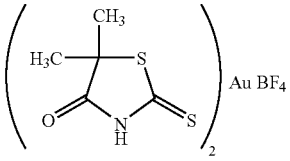

(S-16)

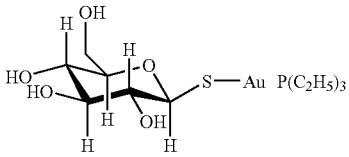

-continued (S-17)

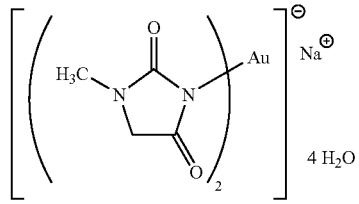

(S-18)

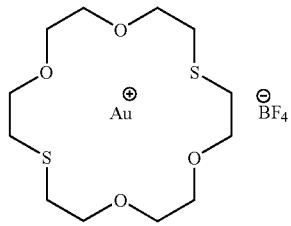

(S-19)

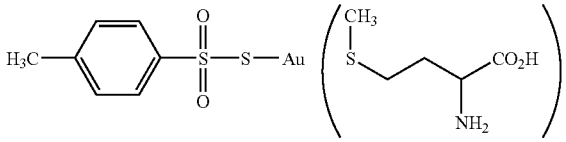

The gold sensitization in the present invention is generally conducted by adding a gold sensitizer to an emulsion and agitating the resultant emulsion for a certain period at a high temperature (preferably 40° C. or higher). The amount of the gold sensitizer added varies according to various conditions, but is generally preferably within a range from $1\times10^{-7}$ to $1\times10^{-4}$ moles per mole of silver halide.

An ordinarily employed gold compound (for example, a chloroaurate salt, potassium chloroaurate, auric trichloride, potassium auric thiocyanate, potassium iodoaurate, tetracyanoauric acid, ammonium aurothiocyanate or pyridyl trichlorogold) may be employed as the gold sensitizer in the invention in combination with to the aforementioned compounds.

The silver halide emulsion to be employed in the present invention may be subjected to another chemical sensitization in combination with the gold sensitization. The chemical sensitization usable in combination can be, for example, sulfur sensitization, selenium sensitization, tellurium sensitization, precious metal sensitization utilizing a metal other than gold, or reduction sensitization. A compound described in JP-A No. 62-215272, lower right column in page 18 to upper right column in page 22 is preferably employed in the chemical sensitization.

Any compound or precursor thereof may be added to the silver halide emulsion to be employed in the present invention during the production steps or storage of the photosensitive material or the processing thereof for the purpose of preventing fog or stabilizing photographic performance. Preferred examples of such a compound are described in JP-A No. 62-215272, pages 39 to 72. A 5-arylamino-1,2,3,4-thiatriazole compound (wherein the aryl residue includes at least an electron-attractive group), described in EP 0,447,647 is also preferably used.

In the present invention, a hydroxamic acid derivative described in JP-A No. 11-109576, a cyclic ketone which has a double bond which adjoins a carbonyl group and whose both ends are substituted by amino groups or hydroxyl groups, as described in JP-A No. 11-327094 (particularly represented by a general formula (S1), wherein paragraphs 0036 to 0071 thereof may be incorporated into the specification of the application), a sulfo-substituted catechol or a hydroquinone described in JP-A No. 11-143011 (for example 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid, or a salt thereof), a hydroxylamine represented by a general formula (A) in U.S. Pat. No. 5,556,741 (in U.S. Pat. No. 5,556,741, a description of column 4, line 56 to column 11, line 22 being preferably applicable to the present application and being incorporated as a part of the present specification), or a water-soluble reducing agent represented by general formulas (I) to (III) in JP-A No. 11-102045 may be advantageously used in order to improve preservability of the silver halide emulsion.

The silver halide emulsion of the invention may include a spectral sensitizing dye in order to provide so-called spectral sensitivity showing a photosensitivity in a desired optical wavelength range. The spectral sensitizing dyes usable for spectral sensitization in the blue, green and red regions can be those described in *F. M. Harmer, Heterocyclic compounds-Cyanine dyes and related compounds*, John Wiley & Sons [New York, London] (1964). Specific examples of the compound and the spectral sensitizing method can be preferably those described in the aforementioned JP-A No. 62-215272, page 22, upper right column to page 38. In particular, a spectral sensitizing dye described in JP-A No. 3-123340 is highly preferable for red sensitization of the silver halide emulsion grains having a high silver chloride content in consideration of stability, a high adsorption property and a temperature dependence of exposure.

An amount of such a spectral sensitizing dye added varies widely depending on the case, but is preferably within a range of $0.5\times10^{-6}$ to $1.0\times10^{-2}$ moles per mole of silver halide, and more preferably of $1.0\times10^{-6}$ to $5.0\times10^{-3}$ moles.

[Silver Halide Color Photographic Photosensitive Material]

The silver halide color photographic photosensitive material of the present invention will be explained hereinafter.

As explained in the foregoing, the silver halide color photographic photosensitive material of the invention includes, on a substrate, a yellow color-developing blue light-sensitive silver halide emulsion layer, a magenta color-developing green light-sensitive silver halide emulsion layer, and a cyan color-developing red light-sensitive silver halide emulsion layer. The yellow color-developing blue light-sensitive silver halide emulsion layer functions as a yellow color-developing layer containing a yellow dye-forming coupler, the magenta color-developing green light-sensitive silver halide emulsion layer functions as a magenta color-developing layer containing a magenta dye-forming coupler, and the cyan color-developing red light-sensitive silver halide emulsion layer functions as a cyan color-developing layer containing a cyan dye-forming coupler. The silver halide emulsions contained respectively in the yellow color-developing layer, the magenta color-developing layer and the cyan color-developing layer are photosensitive to the respective lights having different wavelength regions (for example, lights of blue region, green region and red region).

A material and/or an additive already known for photographic use may be employed in the photosensitive material of the invention.

For example, a translucent support or a reflective support may be used as a photographic support. A transparent film such as a cellulose nitrate film and a polyethylene terephthalate film, or a support having a polyester layer formed by 2,6-naphthalenedicarboxylic acid (NDCA) and ethylene glycol (EG) or formed by NDCA, terephthalic acid and EG and an information recording layer such as a magnetic layer is preferably used as the translucent support. In the present invention, a reflective support (also called a reflection support) is preferable, and a reflective support in which a plurality of polyethylene or polyester layers are laminated as water-resistance resin layers (laminate layers) at least one of which contains a white pigment such as titanium oxide is preferable as such a reflective support.

In the invention, a support having a paper substrate and, on a side of the substrate where the silver halide emulsion layers are to be provided, a polyolefin layer including small pores is more preferable as the reflective support. The polyolefin layer may be formed by a plurality of layers, and, in such a case, a support in which a polyolefin layer adjacent to a gelatin layer at the side of the silver halide emulsion layers is free from small pores (for example, polypropylene or polyethylene), and a polyolefin layer in the vicinity of the paper substrate has small pores is more preferable. The plural or single polyolefin layer disposed between the paper substrate and the photographic layers preferably has a density of from 0.40 to 1.0 g/ml, and more preferably from 0.50 to 0.70 g/ml. Also, the plural or single polyolefin layer disposed between the paper substrate and the photographic layers preferably has a thickness of from 10 to 100 μm, and more preferably from 15 to 70 μm. Also, a thickness ratio of the polyolefin layer to the paper substrate is preferably from 0.05 to 0.2, and more preferably 0.1 to 0.15.

It is also preferable to form a polyolefin layer on a surface (rear surface) of the paper substrate opposite to the photographic layers in order to increase the rigidity of the reflective support, and, in such a case, the polyolefin layer on the rear surface is preferably a polyethylene or polypropylene layer whose surface is matted, and more preferably a polypropylene layer. The polyolefin layer on the rear surface preferably has a thickness of 5 to 50 μm, and more preferably 10 to 30 μm, and preferably has a density of 0.7 to 1.1 g/ml. In the reflective support in the invention, preferred embodiments of the polyolefin layer provided on the paper substrate can be those described in JP-A Nos. 10-333277, 10-333278, 11-52513 and 11-65024, EP 088,0065 and EP 088,0066.

The aforementioned water-resistant resin layer, preferably includes a fluorescent whitening agent. Also, a hydrophilic colloid layer in which the fluorescent whitening agent is dispersed may be separately formed. The fluorescent whitening agent is preferably a benzoxazole, a coumarine, or a pyrazoline, or a derirative thereof and more preferably a benzoxazolylnaphthalene a benzoxazolylstilbene or a derivative thereof. An amount thereof is not particularly limited, but preferably within a range from 1 to 100 mg/m$^2$. In the case of mixing it in the water-resistance resin, a mixing ratio of the fluorescent whitening agent to the resin is preferably 0.0005 to 3 mass %, and more preferably 0.001 to 0.5 mass %.

The reflective support may also be formed by coating a hydrophilic colloid layer containing a white pigment on a translucent support or a reflective support as explained above. Also, the reflective support may have a metallic surface showing mirror reflectivity or secondary diffuse reflectivity.

Also, the support to be employed in the photosensitive material of the invention may be, for a display purpose, a white polyester support or may have a layer containing a white pigment, which is formed on a side of a support bearing the silver halide emulsion layers. Also, in order to improve sharpness, an antihalation layer is preferably provided on a surface of the support which surface has the silver halide emulsion layers or on the rear surface. In particular, in order that the display can be viewed with reflected light or transmitted light, the transmission density of the support is preferably within a range from 0.35 to 0.8.

In the photosensitive material of the invention, in order to improve image sharpness to prevent irradiation or halation or to improve handling safety under a safe light, it is preferable to add a dye that is bleachable by processing (particularly an oxonol dye or a cyanine dye) as described in EP 0,337,490A2, pages 27 to 76 to the hydrophilic colloid layer in such a manner that an optical reflective density of the photosensitive material at 680 nm becomes 0.70 or higher, or to add titanium oxide whose surface is treated with a 2- to 4-valent alcohol (for example, trimethylolethane) to the water-resistant resin layer of the support in an amount of 12 mass % or higher (more preferably 14 mass % or higher).

Also, a dye described in EP 0,819,977 may be preferably used in the invention. Among these water-soluble dyes, some may deteriorate color separation or handling safety under a safe light in the case where the amount thereof is increased. Water-soluble dyes described in JP-A Nos. 5-127324, 5-127325 and 5-216185 are preferable as the dyes usable without deteriorating the color separation.

In the invention, a colored layer that is bleachable by processing can be employed instead of or in combination with the water-soluble dye. The colored layer that is bleachable by processing may be brought into direct contact with the emulsion layer, or an intermediate layer containing an agent for preventing color mixing in processing, such as gelatin or hydroquinone may disposed between the colored layer and the emulsion layer. Such a colored layer is preferably provided under (at the support side of) an emulsion layer that develops a primary color similar to the color of the colored layer. It is possible to individually provide the colored layers corresponding to all the primary colors, or to provide the color layers so as to correspond to arbitrarily selected ones among such primary colors. It is also possible to provide a colored layer which is colored corresponding to plural primary color ranges. The optical reflective density of the colored layer is preferably from 0.2 to 3.0 at a wavelength at which a highest optical density can be obtained within a wavelength range used for the exposure (a visible light range of 400 to 700 nm in the case of the exposure in an ordinary printer, or a wavelength of a scanning exposure light source in the case of a scan exposure). It is more preferably within a range of 0.5 to 2.5, and particularly preferably within a range of 0.8 to 2.0.

A method known in the related art can be used in the colored layer formation. For example, a method of adding a solid particle dispersion of a dye described in JP-A No. 2-282244, page 3, upper right column to page 8, or a dye described in JP-A No. 3-7931, page 3, upper right column to page 11, lower left column to the hydrophilic colloid layer, a method of mordanting a cationic polymer with an anionic dye, a method of causing fine particles such as silver halide grains to adsorb a dye thereby fixing the dye in the layer, or a method employing colloidal silver as described in JP-A No. 1-239544 can be used. A method of adding a dye that is substantially insoluble in water at a pH value of 6 or lower but is substantially water soluble at a pH value of 8 or higher is described in JP-A No. 2-308244, pages 4 to 13 as a method for dispersing fine dye powder in solid state. Also, a method of mordanting a cationic polymer with an anionic dye is described, for example, in JP-A No. 2-84637, pages 18 to 26. Also, a method of preparing colloidal silver as a light absorbing agent is described in U.S. Pat. Nos. 2,688,601 and 3,459,563. Among these, the method of adding the fine powder dye or the method employing colloidal silver is preferable.

The photosensitive material of the invention is applicable to a color negative film, a color positive film, a color reversal film, a color reversal photographic paper, a color photographic paper, a display photosensitive material, a digital color proof, a color positive film for movies, a color negative film for movies and the like, and among these it is preferably applied to a display photosensitive material, a digital color proof, a color positive film for movies, a color reversal photographic paper and a color photographic paper, and more preferably to a color photographic paper. As explained in the foregoing, the color photographic paper preferably has a yellow color-developing blue light-sensitive silver halide emulsion layer, a magenta color-developing green light-sensitive silver halide emulsion layer, and a cyan color-developing red light-sensitive silver halide emulsion layer, and the yellow color-developing blue light-sensitive silver halide emulsion layer, the magenta color-developing green light-sensitive silver halide emulsion layer, and the cyan color-developing red light-sensitive silver halide emulsion layer are generally disposed in that order from the side of the support.

However, another layer configuration may also be adopted.

The blue light-sensitive silver halide emulsion layer may be formed in any position on the support, but, in the case where the blue light-sensitive silver halide emulsion layer contains tabular silver halide grains, it is preferably formed in a position farther from the support than at least either of the green light-sensitive silver halide emulsion layer or the red light-sensitive silver halide emulsion layer. Also, in view of accelerating color-developing processing and silver elimination and reducing a remaining color of the sensitizing dye, the blue light-sensitive silver halide emulsion layer is preferably formed in a position farther, from the support than the other silver halide emulsion layers. Also, the red light-sensitive silver halide emulsion layer is preferably formed in a center position among silver halide emulsion layers in view of reducing a blix fading, and is preferably formed in a lowermost layer in view of reducing a light fading. Also, each of yellow, magenta and cyan color-developing layers may be composed of two or three layers. It is also preferable to form, as one of color developing layers, a coupler layer not including a silver halide emulsion and adjoining a silver halide emulsion layer, as described in JP-A Nos. 4-75055, 9-114035 and 10-246940 and U.S. Pat. No. 5,576,159.

As the silver halide emulsion, other materials (for example, additives) and photographic layers (for example, layer arrangement) to be employed in the invention, and a processing method and processing additives to be employed for processing the photosensitive material of the invention, those described in JP-A Nos. 62-215272 and 2-33144, and European Patent No. 0,355,660A2, particularly those described in European Patent No. 0,355,660A2 can be advantageously employed. A silver halide color photographic photosensitive material and a processing method therefor described in JP-A Nos. 5-34889, 4-359249, 4-313753, 4-270344, 5-66527, 4-34548, 4-145433, 2-854, 1-158431, 2-90145, 3-194539 and 2-93641 and EP-A No. 0,520,457A2 are also preferable.

In particular, as the reflective support, the silver halide emulsion, different metal ions to be doped in the silver halide grains, a stabilizer or an antifoggant for the silver halide emulsion, the chemical sensitizing method (sensitizer), the spectral sensitizing method (spectral sensitizer), cyan, magenta and yellow dye-forming couplers, an emulsifying/dispersing method thereof, a color image preservability improving agent (antistain agent or antifading agent), a dye (colored layer), a gelatin type, a layer configuration of the photosensitive material and a coated film pH of the photosensitive material, those described in portions of patent references shown in Table 1 can be particularly advantageously employed.

TABLE 1

| Element | JP-A No.7-104448 | JP-A No.7-77775 | JP-A No. 7-301895 |
|---|---|---|---|
| Reflective support | column 7, line 12-column 12, line 19 | column 35, line 43-column 44, line 1 | column 5, line 40-column 9, line 26 |
| Silver halide emulsion | column 72, line 29-column 74, line 18 | column 44, line 36-column 46, line 29 | column 77, line 48-column 80, line 28 |
| Different metal ion | column 74, lines 19-44 | column 46, line 30-column 47, line 5 | column 80, line 29-column 81, line 6 |
| Stabilizer or antifoggant | column 75, lines 9-18 | column 47, lines 20-29 | column 18, line 11-column 31, line 37 (particularly mercapto heterocyclic compound) |
| Chemical sensitization (chemican sensitizer) | column 74, line 45-column 75, line 6 | column 47, lines 7-17 | column 81, lines 9-17 |
| Spectral sensitization (spectral sensitizer) | column 75, line 19-column 76, line 45 | column 47, line 30-column 49, line 6 | column 81, line 21-column 82, line 48 |
| Cyan dye-forming coupler | column 12, line 20-column 39, line 49 | column 62, line 50-column 63, line 16 | column 88, line 49-column 89, line 16 |
| Yellow dye-forming coupler | column 87, line 40-column 88, line 3 | column 63, lines 17-30 | column 89, lines 17-30 |
| Magenta dye-forming coupler | column 88, lines 4-18 | column 63, line 3-column 64, line 11 | column 31, line 34-column 77, line 44 and column 88, lines 32-46 |
| Coupler emulsifying method | column 71, line 3-column 72, line 11 | column 61, lines 36-49 | column 87, lines 35-48 |
| Color image preservability improving agent (antistain agent) | column 39, line 50-column 70, line 9 | column 61, line 50-column 62, line 49 | column 87, line 49-column 88, line 48 |
| Antifading agent | column 70, line 10-column 71, line 2 | | |
| Dye (coloring agent) | column 77, line 42-column 78, line 41 | column 7, line 14-column 19, line 42 and column 50, line 3-column 51, line 14 | column 9, line 27-column 18, line 10 |
| Gelatin type | column 78, lines 42-48 | column 51, lines 15-20 | column 83, lines 13-19 |
| Layer configuration of photosensitive mat. | column 39, lines 11-26 | column 44, lines 2-35 | column 31, line 38-column 32, line 33 |
| Film pH of photosensitive material | column 72, lines 12-28 | | |
| Scan exposure | column 76, line 6-column 77, line 41 | column 49, line 7-column 50, line 2 | column 82, line 49-column 83, line 12 |
| Preservative in developer | column 88, line 19-column 89, line 22 | | |

Moreover, those described in JP-A No. 62-215272, page 91, upper right column, line 4 to page 121, upper left column, line 6, JP-A No. 2-33144, page 3, upper right column, line 14 to page 18, upper left column, last line and page 30, upper right column, line 6 to page 35, lower right column, line 11, and EP 0355,660A2, page 4, lines 15 to 27; page 5, lines 30 to page 28, last line; page 45, lines 29 to 31; and page 47, line 23 to page 63, line 50 are also useful as the cyan, magenta and yellow dye-forming couplers employed in the invention.

A compound represented by general formula (II) or (III) in WO98/33760 or a general formula (D) in JP-A No. 10-221825 may be also preferably used in the invention.

A pyrrolotriazole coupler is preferably used as a cyan dye-forming coupler (hereinafter simply called "cyan coupler") employable in the invention, and a coupler represented by a general formula (I) or (II) in JP-A No. 5-313324, a coupler represented by a general formula (I) in JP-A No. 6-347960 and coupler examples described in these patent references are particularly preferably used. Phenol and naphthol cyan couplers are also preferable and, for example, a cyan coupler represented by a general formula (ADF) in JP-A No. 10-333297 is preferable. A pyrroloazole cyan coupler described in European patents EP0,488,248 and EP0,491,197A1, a 2,5-diacylaminophenol coupler described in U.S. Pat. No. 5,888,716, a pyrazoloazole cyan coupler having an electron-attractive group or a hydrogen bonding group in 6-position described in U.S. Pat. Nos. 4,873,183 and 4,916,051 are also preferable as a cyan coupler other than those described in the foregoing, and a pyrazolozaole cyan coupler having a carbamoyl group in 6-position described in JP-A Nos. 8-171185, 8-311360 and 8-339060 is particularly preferable.

Also, in addition to a diphenylimidazole cyan coupler described in JP-A No. 2-33144, a 3-hydroxypyridine cyan coupler described in European Patent EP0,333,185A2 (A 2-equivalent coupler formed by including a chlorine leaving groups in a 4-equipment coupler (42) listed in examples, or a coupler (6) or (9) is particularly preferable.), a cyclic active methylene cyan coupler described in JP-A No. 64-32260 (Specific examples 3, 8 and 34 of the coupler are particularly preferable), a pyrrolopyrazole cyan coupler described in European Patent EP0,456,226A1, and a pyrroloimidazole cyan coupler described in European Patent EP0,484,909 may be used.

Among these cyan couplers, a pyrroloazole cyan coupler represented by a general formula (I) in JP-A No. 11-282138 is particularly preferable, and a description of this patent reference in paragraphs 0012 to 0059, including example cyan couplers (1)-(47), is directly applicable to the present application and is preferably incorporated as a part of the present specification.

A 5-pyrazolone magenta dye-forming coupler (hereinafter simply called "magenta coupler") or a pyrazoloazole magenta coupler as described in known references in the foregoing table can be used as a magenta coupler employable in the invention, but a pyrazolotriazole coupler in which a secondary or tertiary alkyl group is directly bonded to 2-, 3- or 6-position of the pyrazolotriazole ring as described in JP-A No. 61-65245, a pyrazoloazole coupler including a sulfonamide group within a molecule as described in JP-A No. 61-65246, a pyrazoloazole coupler having an alkoxyphenylsulfone ballast group as described in JP-A No. 61-147254, and a pyrazoloazole coupler having an alkoxy group or an aryloxy group in 6-position as described in European Patents Nos. 226,849A and 294,785A are preferable in consideration of a color hue, an image stability and a color developing ability. A pyrroloazole coupler represented by a general formula (M-I) in JP-A No. 8-122984 is particularly preferable as the magenta coupler, and a description of this patent reference in paragraphs 0009 to 0026 is directly applicable to the present application and is preferably incorporated as a part of the present specification. In addition, a pyrazoloazole coupler having steric hindering groups in 3- and 6-positions is also preferably used, as described in European Patents Nos. 854,384 and 884,640.

In addition to compounds described in the foregoing table, as a yellow dye-forming coupler (hereinafter also simply called "yellow coupler") employable in the invention, an acylacetamide yellow coupler having a 3- to 5-membered cyclic structure in an acyl group as described in European Patent EP0,447,969A1, a malondianilide yellow coupler having a cyclic structure described in European Patent EP0,482,552A1, a pyrrol-2 or 3-yl or indol-2 or 3-yl carbonylacetanilide coupler described in EP-A Nos. 953,870A1, 953,871A1, 953,872A1, 953,873A1, 953,874A1 and 953,875A1, and an acylacetamide yellow coupler having a dioxane structure as described in U.S. Pat. No. 5,118,599 can be used. Among these, an acylacetamide yellow coupler in which the acyl group is 1-alkylcyclopropane-1-carbonyl group and a malondianilide yellow coupler in which one of anilides constitutes an indoline ring are particularly preferable. These couplers may be used alone or in combination.

It is preferable that the coupler to be employed in the present invention is preferably impregnated with a loadable latex polymer (cf. U.S. Pat. No. 4,203,716) in the presence (or absence) of an organic solvent having a high-boiling point described in the foregoing table, or dissolved together with a polymer insoluble in water but soluble in an organic solvent and that the coupler impregnated with the loadable latex polymer or the resultant solution is and emulsified in an aqueous hydrophilic colloid solution. The preferred polymer that is insoluble in water but soluble in organic solvent can be a homopolymer or a copolymer described in U.S. Pat. No. 4,857,449, columns 7-15, and WO 88/00723, pages 12 to 30. A methacrylate or acrylamide polymer is more preferable, and an acrylamide polymer is particularly preferably employed in consideration of the color image stability.

In the invention, a known color mixing preventing agent can be employed, and those described in the following patent references are preferable as such.

For example, a redox compound described in JP-A No. 5-333501, a phenidone or hydrazine compound described in WO 98/33760 and U.S. Pat. No. 4,923,787, or a white coupler described in JP-A Nos. 5-249637 and 10-282615 and German Patent No. 19,629,142A1 can be employed. In particular, in the case of elevating pH of the developer thereby accelerating development, redox compounds described in German Patent No. 19,618,786A1, European Patents Nos. 839,623A1 and 842,975A1, German Patent No. 19,806,846A1 and French Patent No. 2,760,460A1 can be employed.

A compound having a triazine skeleton which has a high molar absorption coefficient is preferably employed as an ultraviolet absorbent in the invention, and compounds described, for example, in the following patent references can be employed as such. Such a compound may be preferably added to a photosensitive layer and/or a non-photosensitive layer. For example, compounds described in JP-A Nos. 46-3335, 55-152776, 5-197074, 5-232630, 5-307232, 6-211813, 8-53427, 8-234364, 8-239368, 9-31067, 10-115898, 10-147577 and 10-182621, German Patent No. 19,739,797A, European Patent No. 711,804A and JP-A No. 8-501291 can be employed.

Gelatin is advantageously employed as a binder or a protective colloid employable in the photosensitive material of the invention, but other hydrophilic colloids may also be employed alone or in combination with gelatin. In preferred gelatin, a content of heavy metals contained as impurities such as iron, copper, zinc and manganese is preferably 5 ppm or less, and more preferably 3 ppm or less. Also, an amount of calcium included in the photosensitive material is preferably 20 mg/m$^2$ or less, more preferably 10 mg/m$^2$ or less and most preferably 5 mg/m$^2$ or less.

In the invention, in order to avoid various molds and bacteria which deteriorate the image by proliferation in the hydrophilic colloid layer, it is preferable to add an antimold or antibacterial agent as described in JP-A No. 63-271247. Also, a pH value of films of the photosensitive material is preferably within a range from 4.0 to 7.0, and more preferably from 4.0 to 6.5.

In the invention, a surfactant may be added to the photosensitive material in view of improving the coating stability of the photosensitive material, preventing generation of electrostatic charge and regulating a charge amount. The surfactant includes an anionic surfactant, a cationic surfactant, a betaine surfactant and a nonionic surfactant, such as those described in JP-A No. 5-333492. A surfactant including a fluorine atom is preferable as the surfactant in the invention. Such a fluorine atom-containing surfactant may be used alone or in combination with another known surfactant, but is preferably used in combination with another known surfactant. An amount of the surfactant added to the photosensitive material is not particularly limited, but is generally within a range from $1\times10^{-5}$ to 1 g/m$^2$, preferably $1\times10^{-4}$ to $1\times10^{-1}$ g/m$^2$ and more preferably $1\times10^{-3}$ to $1\times10^{-2}$ g/m$^2$.

The photosensitive material of the present invention can form an image by the steps of exposing the photosensitive material to light according to image information, and developing the exposed photosensitive material.

The photosensitive material of the invention is not only usable in a print system employing an ordinary negative printer, but also suitable to a scan exposure system employing a cathode ray tube (CRT). The CRT exposure apparatus is simpler, more compact and less expensive in comparison with an apparatus utilizing a laser. Also, adjustments of optical axis and colors are easier. Various light emitting members showing light emissions in necessary spectral regions are employed in the cathode ray tube employed for image exposure. For example, either one of a red light emitting member, a green light emitting member and a blue light emitting member, or a mixture of two or more thereof is employed. The spectral regions are not limited to red, green and blue mentioned above, but a fluorescent member emitting light in yellow, orange, purple or infrared region may also be used. In particular, a cathode ray tube emitting white light by mixing these light emitting members is often used.

In the case where the photosensitive material includes a plurality of photosensitive layers having different spectral sensitivity distributions and the cathode ray tube has fluorescent members showing light emissions in plural spectral regions, it is possible to irradiate plural lights having different colors at the same time. Namely, it is possible to cause the cathode ray tube to emit light by inputting image signals of plural colors into the tube. A method of inputting image signals of respective colors into the tube in succession to cause the tube to emit light of respective colors in succession, and conducting an exposure through a film that intercepts colors other than an exposed color (face-sequential exposure) may also be adopted, and, in general, the face-sequential exposure is preferable in that it can provide a high image quality, since a cathode ray tube having a high resolution can be employed in such a method.

In order to irradiate the photosensitive material of the invention, a digital scan exposure method utilizing a monochromic high-density light of a gas laser, a light emitting diode, a semiconductor laser, or a second harmonic generating light source (SHG) formed by a combination of a semiconductor laser or a solid-state laser utilizing a semiconductor laser as an exciting light source and a non-linear optical crystal is preferably employed. In order to obtain a compact and inexpensive system, it is preferable to use a semiconductor laser, or a second harmonic generating light source (SHG) formed by a combination of a semiconductor laser or a solid-state laser utilizing a semiconductor laser as an exciting light source and a non-linear optical crystal. In particular, in order to design a compact, inexpensive apparatus having a long service life and a high stability, the use of a semiconductor laser is preferable, and it is preferable to use a semiconductor laser in at least one of the exposure light sources.

The photosensitive material of the invention is preferably imagewise exposed to coherent light from a blue laser having a light emission wavelength range of 420 to 460 nm. Among blue lasers, a blue semiconductor laser is particularly preferable.

A blue semiconductor laser having a wavelength of 430 to 450 nm (announced by Nichia Kagaku Co. in March 2001, at 48th Applied Physics United Symposium), a blue laser having a wavelength of about 470 nm, obtained from a semiconductor laser (oscillation wavelength: about 940 nm) by a wavelength conversion with an $LiNbO_3$ SHG crystal having a waveguide-shaped inverted domain structure, a green laser haivng a wavelength of about 530 nm, obtained from a semiconductor laser (oscillation wavelength: about 1060 nm) by a wavelength conversion with an $LiNbO_3$ SHG crystal having a waveguide-shaped inverted domain structure, a red semiconductor laser having a wavelength of about 685 nm (Hitachi Type No. HL6738MG), and a red semiconductor laser haivng a wavelength of about 650 nm (Hitachi Type No. HL6501MG) can be preferably employed as specific examples of the laser light source.

In the case of utilizing such a scan exposure light source, a spectral sensitivity peak wavelength of the photosensitive material of the invention can be arbitrarily set according to the wavelength of the scan exposure light source to be used. A blue light and a green light can be obtained from an SHG light source, formed by combining a solid state laser utilizing, as an excitation light source, a semiconductor laser or a semiconductor laser and a non-linear optical crystal, since it can halve the oscillation wavelength of the laser. Consequently, the spectral sensitivity peaks of the photosensitive material can be provided in the ordinary three wavelength regions of blue, green and red. An exposure time in such scan exposure, defined as a time to irradiate a pixel size at a pixel density of 400 dpi, is preferably $10^{-4}$ sec or less, and more preferably $10^{-6}$ sec or less.

The silver halide color photographic photosensitive material of the invention can be advantageously employed in combination with an exposure or development system described in following related references. Examples of such a system include an automatic print and development system described in JP-A No. 10-333253, a photosensitive material transporting apparatus described in JP-A No. 2000-10206, a recording system including an image reading apparatus described in JP-A No. 11-215312, an exposure system utilizing a color image recording method described in JP-A Nos. 11-88619 and 10-202950, a digital photoprint system including a remote diagnostic method described in JP-A No. 10-210206, and a photoprint system including an image recording apparatus described in JP-A No. 10-159187.

The preferable scan exposure method applicable to the invention is explained in detail in the patent references described in the foregoing table.

In an exposure of the photosensitive material of the invention in a printer, a band stop filter described in U.S. Pat. No. 4,880,726 is preferably used, and such use eliminates color mixing and significantly improves color reproducibility.

A copy regulation by a pre-exposure of a yellow microdot pattern before the image information is provided may be applied to the invention, as described in European Patents EP 0,789,270A1 and EP 0,789,480A1.

As for processing the photosensitive material of the invention, a processing material and a processing method described in JP-A No. 2-207250, page 26, lower right column, line 1 to page 34, upper right column, line 9, and in JP-A No. 4-97355, page 5, upper left column, line 17 to page 18, lower right column, line 20 can be advantageously employed. Compounds described in the patent references in the foregoing table can also be advantageously employed as a preservative to be employed in the developing liquid.

The photosensitive material of the invention can be advantageously employed as a photosensitive material suitable for rapid processing. In the case of a rapid processing, the color developing time is preferably 30 seconds or less, more preferably within a range from 25 to 6 seconds, and further preferably from 20 to 6 seconds. Similarly a bleach-fixing time is preferably from 30 seconds or less, more preferably within a range from 25 to 6 seconds, and further preferably from 20 to 6 seconds. Also, a rinsing or stabilizing time is preferably 60 seconds or less, and more preferably within a range from 40 to 6 seconds.

The color developing time means a time from the entry of the photosensitive material into a color developing solution to the entry into a bleach-fixing solution in the next processing step. In the case of a processing, for example, in an automatic processor, the color development time means a sum of a time in which the photosensitive material is immersed in the color developing solution (so-called in-liquid time) and a time in which the photosensitive material, after leaving the color developing solution, is transported in the air toward the bleach-fixing bath in a next step (so-called in-air time). Similarly, a bleach-fixing time means a time from the entry of the photosensitive material in the bleach-fixing solution to the entry in a next rinsing or stabilizing bath. Also, a rinsing or stabilizing time means a time in which the photosensitive material, from the entry thereof into the rinsing or stabilizing solution, remains in the solution toward a drying step (so-called in-liquid time).

For the photosensitive material of the invention, the color development time is 20 seconds or less, preferably 6 to 20 seconds and more preferably 6 to 15 seconds. In the invention, execution of the color developing process with a color development time of 20 seconds or less means that the above-mentioned color development time (not the time of the entire color development process) is 20 seconds or less.

A wet process such as a method of developing the photosensitive material with a developing solution containing an alkali agent and a developing agent as known in the related art, or a method of developing the photosensitive material containing the developing agent with an activator solution such as an alkali solution not including the developing agent or a thermal developing process without employing a processing liquid may be employed as the method for developing the photosensitive material of the invention after the exposure thereof. In particular, the activator process, owing to a fact that the developing agent is not contained in the processing solution, facilitates management and handling of the processing solution and reduces the burden in the disposal of the used solution, thereby being also preferable for environmental protection.

In the activator method, a hydrazine compound described, for example, in JP-A Nos. 8-234388, 9-152686, 9-152693, 9-211814 and 9-160193 is preferable as the developing agent or a precursor thereof to be included in the photosensitive material.

A developing method which reduces a coated amount of silver in the photosensitive material and conducts an image amplifying process (intensifying process) with hydrogen peroxide can also be advantageously employed. It is particularly preferable to apply this method to the activator process. Specifically, an image forming method utilizing an activator solution including hydrogen peroxide described in JP-A Nos. 8-297354 and 9-152695 is preferably employed. In the activator process, a silver-removing step is usually conducted after the processing with the activator solution, but, in an image amplifying process utilizing a photosensitive material of a low silver amount, it is possible to employ a simplified process of conducting a rinsing step with water or a stabilizing step, skipping the silver-removing step. Also, in the case where the image information is read from the photosensitive material, for example, by a scanner, a process not including the silver-removing step may be employed even if a photosensitive material has a high silver content such as a high-sensitivity photosensitive material for photgraphy.

The processing materials such as the activator solution, the silver-removing solution (bleach/fixing solution), the rinsing and stabilizing solution and the processing method, to be employed in the invention, can be those known in the related art. Those described in *Research Disclosure*, Item 36544, p. 536-541 (September 1994), and JP-A No. 8-234388 are preferably used.

EXAMPLES

In the following, the present invention will be explained further with examples, but the invention is by no means limited to these examples.

Example 1

Preparation of Emulsion B-1

1000 ml of a 3% aqueous solution of lime-processed gelatin was adjusted such that pH and pC thereof became 5.5 and 11.7, respectively, and an aqueous solution containing 2.12 moles of silver nitrate and an aqueous solution containing 2.2 moles of sodium chloride were simultaneously added thereto at 66° C. while vigorously agitating the gelatin solution. In a period where the addition of silver nitrate had been 80% to 90% completed, potassium bromide was added to the system in an amount corresponding to 2 mol % per mole of silver halide to be formed while vigorously agitating the system. Also, in a period where the addition of silver nitrate had been 80% to 90% completed, an aqueous solution of $K_4[Ru(CN)_6]$ was added to the system in an Ru amount corresponding to $3\times10^{-5}$ moles per mole of silver halide to be formed. Moreover, in a period where the addition of silver nitrate had been 83% to 88% completed, an aqueous solution of $K_2[IrCl_6]$ was added to the system in an Ir amount corresponding to $3\times10^{-8}$ moles per mole of silver halide to be formed. Also, at a point where the addition of silver nitrate had been 90% completed, an aqueous solution of potassium iodide was added to the system in an I amount corresponding to 0.2 mol % per mole of silver halide to be formed while vigorously agitating the system. Moreover, in a period where the addition of silver nitrate had been 92% to 98% completed, an aqueous solution of $K_2[Ir(5\text{-methylthiazole})Cl_5]$ was added to the system in an Ir amount corresponding to $1\times10^{-6}$ moles per mole of silver halide to be formed. After a desalting process at 40° C., 168 g of lime-processed gelatin were added to the system, and the resultant mixture was adjusted such that pH and pC thereof became 5.5 and 11.8, respectively. An emulsion containing cubic silver iodobromochloride grains which had a sphere-equivalent diameter of 0.75 μm and a variation factor of 11% was obtained.

The emulsion was melted at 40° C., and sodium thiosulfonate was added thereto in an amount of $2\times10^{-5}$ moles per mole of silver halide, and the emulsion was ripened to an optimum state at 60° C. employing sodium thiosulfate pentahydrate as a sulfur sensitizer and (S-2) as a gold sensitizer. After the temperature of the system was lowered to 40° C., a sensitizing dye A of a following structure, a sensitizing dye B of a following structure, 1-phenyl-5-mercaptotetrazole, 1-(5-methylureidophenyl)-5-mercaptotetrazole, and potassium bromide were added to the ripened emulsion in respective amounts of $2\times10^{-4}$ moles, $1\times10^{-4}$ moles, $2\times10^{-4}$ moles, $2\times10^{-4}$ moles, and $2\times10^{-3}$ moles per mole of silver halide. The emulsion B-1 was thus obtained.

Sensitizing dye A

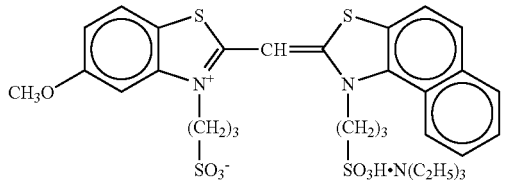

Sensitizing dye B

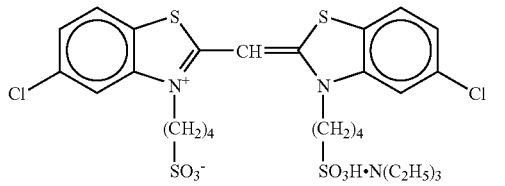

Preparation of Emulsion B-2

1000 ml of a 3% aqueous solution of lime-processed gelatin was adjusted such that pH and pC thereof became 5.5 and 11.7, respectively, and an aqueous solution containing 2.12 moles of silver nitrate and an aqueous solution containing 2.2 moles of sodium chloride were simultaneously added thereto at 55° C. while vigorously agitating the gelatin solution. In a period where the addition of silver nitrate had been 80% to 90% completed, potassium bromide was added to the system in an amount corresponding to 2 mol % per mole of silver halide to be formed while vigorously agitating the system. Also, in a period where the addition of silver nitrate had been 80% to 90% completed, an aqueous solution of $K_4[Ru(CN)_6]$ was added to the system in an Ru amount corresponding to $3\times10^{-5}$ moles per mole of silver halide to be formed. Moreover, in a period where the addition of silver nitrate had been 83% to 88% completed, an aqueous solution of $K_2[IrCl_6]$ was added to the system in an Ir amount corresponding to $5\times10^{-8}$ moles per mole of silver halide to be formed. Also, at a point where the addition of silver nitrate had been 90% completed, an aqueous solution of potassium iodide was added to the system in an I amount corresponding to 0.3 mol % per mole of silver halide to be formed while vigorously agitating the system. Moreover, in a period where the addition of silver nitrate had been 92% to 98% completed, an aqueous solution of $K_2[Ir(5\text{-methylthiazole})Cl_5]$ was added to the system in an Ir amount corresponding to $1.7\times10^{-6}$ moles per mole of silver halide to be formed. After a desalting process at 40° C., 168 g of lime-processed gelatin were added to the system, and pH and pC of the resultant mixture was adjusted to 5.5 and 11.8, respectively. A silver iodobromochloride emulsion which had cubic silver iodobromochloride grains having a sphere-equivalent diameter of 0.55 μm and a variation factor of 11% was obtained.

The emulsion was melted at 40° C., and then sodium thiosulfonate was added to the emulsion in an amount of $2\times10^{-5}$ moles per mole of silver halide, and the emulsion was ripened to an optimum state at 60° C. employing sodium thiosulfate pentahydrate as a sulfur sensitizer and (S-2) as a gold sensitizer. After the temperature of the emulsion was lowered to 40° C., a sensitizing dye A, a sensitizing dye B, 1-phenyl-5-mercaptotetrazole, 1-(5-methylureidophenyl)-5-mercaptotetrazole and potassium bromide were added to the emulsion in respective amounts of $2.7\times10^{-4}$ moles, $1.4\times10^{-4}$ moles, $2.7\times10^{-4}$ moles, $2.7\times10^{-4}$ moles and $2.7\times10^{-3}$ moles per mole of silver halide. The emulsion B-2 was thus obtained.

Preparation of Emulsion G-1

1000 ml of a 3% aqueous solution of lime-processed gelatin was adjusted such that pH and pC therof became 5.5 and 11.7, respectively, and an aqueous solution containing 2.12 moles of silver nitrate and an aqueous solution containing 2.2 moles of sodium chloride were simultaneously mixed with the gelatin solution at 50° C. while vigorously agitating the gelatin solution. In a period where the addition of silver nitrate had been 80% to 100% completed, potassium bromide was added to the resultant mixture (system) in an amount corresponding to 3 mol % per mole of silver halide to be formed while vigorously agitating the system. Also, in a period where the addition of silver nitrate had been 80% to 90% completed, an aqueous solution of $K_4[Ru(CN)_6]$ was added to the system in an Ru amount corresponding to $3\times10^{-5}$ moles per mole of silver halide to be formed. Moreover, in a period where the addition of silver nitrate had been 83% to 88% completed, an aqueous solution of $K_2[IrCl_6]$ was added to the system in an Ir amount corresponding to $5\times10^{-8}$ moles per mole of silver halide to be formed. Also, at a point where the addition of silver nitrate had been 90% completed, an aqueous solution of potassium iodide was added to the system in an I amount corresponding to 0.05 mol % per mole of silver halide to be formed while vigorously agitating the system. Moreover, in a period where the addition of silver nitrate had been 92% to 95% completed, an aqueous solution of $K_2[Ir(5\text{-methylthiazole})Cl_5]$ was added to the system in an Ir amount corresponding to $5\times10^{-7}$ moles per mole of silver halide to be formed. Also, in a period where the addition of silver nitrate had been 95% to 98% completed, an aqueous solution of $K_2[Ir(H_2O)\ Cl_5]$ was added to the system in an Ir amount corresponding to $5\times10^{-7}$ moles per mole of silver halide to be formed. After a desalting process at 40° C., 168 g of lime-processed gelatin were added to the system, and pH and pC of the resultant mixture was adjusted to 5.5 and 11.8, respectively. A silver chloride emulsion was obtained which had cubic silver chloride grains having a sphere-equivalent diameter of 0.45 μm and a variation factor of 10%.

The emulsion was melted at 40° C., then sodium thiosulfonate was added to the emulsion in an amount of $2\times10^{-5}$ moles per mole of silver halide, and the emulsion was ripened to an optimum state at 60° C. employing sodium thiosulfate pentahydrate as a sulfur sensitizer and (S-2) as a gold sensitizer. After the temperature of the emulsion was lowered to 40° C., a sensitizing dye D of a following structure, 1-phenyl-5-mercaptotetrazole, 1-(5-methylureidophenyl)-5-mercaptotetrazole,and potassium bromide were added to the emulsion in respective amounts of 4.7×

$10^{-4}$ moles, $1.6\times10^{-4}$ moles, $6.2\times10^{-4}$ moles and $5.4\times10^{-3}$ moles per mole of silver halide. The emulsion G-1 was thus obtained.

Sensitizing dye D

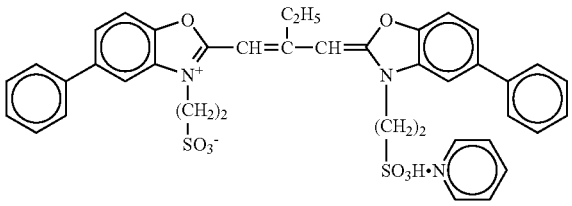

Preparation of Emulsion G-2

1000 ml of a 3% aqueous solution of lime-processed gelatin was adjusted such that pH and pC thereof became 5.5 and 11.7, respectively, and an aqueous solution containing 2.12 moles of silver nitrate and an aqueous solution containing 2.2 moles of sodium chloride were simultaneously mixed with the gelatin solution at 45° C. while vigorously agitating the gelatin solution. In a period where the addition of silver nitrate had been 80% to 100% completed, potassium bromide was added to the resultant mixture (system) in an amount corresponding to 4 mol % per mole of silver halide to be formed while vigorously agitating the system. Also, in a period where the addition of silver nitrate had been 80% to 90% completed, an aqueous solution of $K_4[Ru(CN)_6]$ was added to the system in an Ru amount corresponding to $3\times10^{-5}$ moles per mole of silver halide to be formed. Moreover, in a period where the addition of silver nitrate had been 83% to 88% completed, an aqueous solution of $K_2[IrCl_6]$ was added to the system in an Ir amount corresponding to $5\times10^{-8}$ moles per mole of silver halide to be formed. Also, at a point where the addition of silver nitrate had been 90% completed, an aqueous solution of potassium iodide was added to the system in an I amount corresponding to 0.15 mol % per mole of silver halide to be formed while vigorously agitating the system. Moreover, in a period where the addition of silver nitrate had been 92% to 95% completed, an aqueous solution of $K_2[Ir(5\text{-methylthiazole})Cl_5]$ was added to the system in an Ir amount corresponding to $5\times10^{-7}$ moles per mole of silver halide to be formed. Also, in a period where the addition of silver nitrate had been 95% to 98% completed, an aqueous solution of $K_2[Ir(H_2O)\ Cl_5]$ was added to the system in an Ir amount corresponding to $5\times10^{-7}$ moles per mole of silver halide to be formed. After a desalting process at 40° C., 168 g of lime-processed gelatin were added to the system, and pH and pC of the mixture was adjusted to 5.5 and 11.8, respectively. A silver chloride emulsion was obtained which had cubic grains having a sphere-equivalent diameter of 0.35 μm and a variation factor of 10%.

The emulsion was melted at 40° C., then sodium thiosulfonate was added to the emulsion in an amount of $2\times10^{-5}$ moles per mole of silver halide, and the emulsion was ripened to an optimum state at 60° C. employing sodium thiosulfate pentahydrate as a sulfur sensitizer and (S-2) as a gold sensitizer. After the temperature of the emulsion was lowered to 40° C., a sensitizing dye D, 1-phenyl-5-mercaptotetrazole, 1-(5-methylureidophenyl)-5-mercaptotetrazole and potassium bromide were added to the emulsion in respective amounts of $6\times10^{-4}$ moles, $2\times10^{-4}$ moles, $8\times10^{-4}$ moles and $7\times10^{-3}$ moles per mole of silver halide. The emulsion G-2 was thus obtained.

Preparation of Emulsion R-1

1000 ml of a 3% aqueous solution of lime-processed gelatin was adjusted such that pH and pC thereof became 5.5 and 11.7, respectively, and an aqueous solution containing 2.12 moles of silver nitrate and an aqueous solution containing 2.2 moles of sodium chloride were simultaneously mixed with the gelatin solution at 50° C. while vigorously agitating the gelatin solution. In a period where the addition of silver nitrate had been 80% to 100% completed, potassium bromide was added to the resultant mixture (system) in an amount corresponding to 3 mol % per mole of silver halide to be formed while vigorously agitating the system. Also, in a period where the addition of silver nitrate had been 80% to 90% completed, an aqueous solution of $K_4[Ru(CN)_6]$ was added to the system in an Ru amount corresponding to $3\times10^{-5}$ moles per mole of silver halide to be formed. Moreover, in a period where the addition of silver nitrate had been 83% to 88% completed, an aqueous solution of $K_2[IrCl_6]$ was added to the system in an Ir amount corresponding to $5\times10^{-8}$ moles per mole of silver halide to be formed. Also, at a point where the addition of silver nitrate had been 90% completed, an aqueous solution of potassium iodide was added to the system in an I amount corresponding to 0.05 mol % per mole of silver halide to be formed while vigorously agitating the system. Moreover, in a period where the addition of silver nitrate had been 92% to 95% completed, an aqueous solution of $K_2[Ir(5\text{-methylthiazole})Cl_5]$ was added to the system in an Ir amount corresponding to $5\times10^{-7}$ moles per mole of silver halide to be formed. Also, in a period where the addition of silver nitrate had been 95% to 98% completed, an aqueous solution of $K_2[Ir(H_2O)\ Cl_5]$ was added to the system in an Ir amount corresponding to $5\times10^{-7}$ moles per mole of silver halide to be formed. After a desalting process at 40° C., 168 g of lime-processed gelatin were added to the system, and pH and pC of the resultant mixture was adjusted to 5.5 and 11.8, respectively. A silver bromoiodide emulsion was obtained which had cubic grains having a sphere-equivalent diameter of 0.45 μm and a variation factor of 10%.

The emulsion was melted at 40° C., then sodium thiosulfonate was added to the emulsion in an amount of $2\times10^{-5}$ moles per mole of silver halide, and the emulsion was ripened to an optimum state at 60° C. employing sodium thiosulfate pentahydrate as a sulfur sensitizer and (S-2) as a gold sensitizer. After the temperature of the emulsion was lowered to 40° C., a sensitizing dye H of a following structure, 1-phenyl-5-mercaptotetrazole, 1-(5-methylureidophenyl)-5-mercaptotetrazole, a compound I and potassium bromide were added to the emulsion in respective amounts of $1.6\times10^{-4}$ moles, $1.6\times10^{-4}$ moles, $6.2\times10^{-4}$ moles, $7.7\times10^{-4}$ moles, and $5.4\times10^{-3}$ moles per mole of silver halide. The emulsion R-1 was thus obtained.

Sensitizing dye H

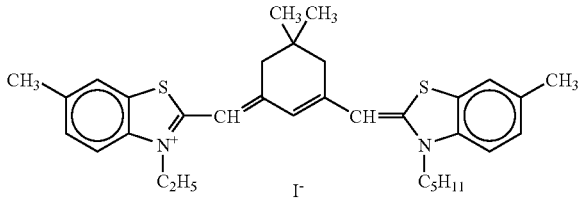

-continued

Compound I

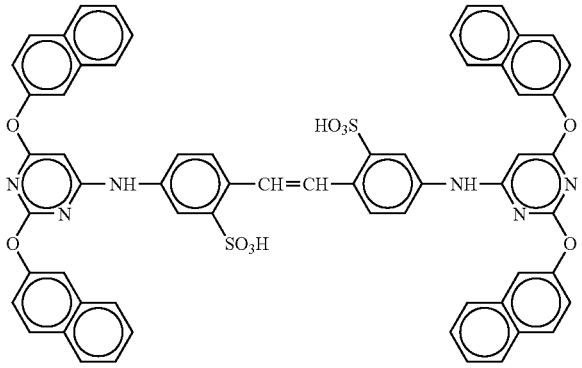

Preparation of Emulsion R-2

1000 ml of a 3% aqueous solution of lime-processed gelatin was adjusted such that pH and pC thereof became 5.5 and 11.7, respectively, and an aqueous solution containing 2.12 moles of silver nitrate and an aqueous solution containing 2.2 moles of sodium chloride were simultaneously mixed with the gelatin solution at 45° C. while vigorously agitating the gelatin solution. In a period where the addition of silver nitrate had been 80% to 100% completed, potassium bromide was added to the resultant mixture (system) in an amount corresponding to 4 mol % per mole of silver halide to be formed while vigorously agitating the system. Also, in a period where the addition of silver nitrate had been 80% to 90% completed, an aqueous solution of $K_4[Ru(CN)_6]$ was added to the system in an Ru amount corresponding to $3\times10^{-5}$ moles per mole of silver halide to be formed. Moreover, in a period where the addition of silver nitrate had been 83% to 88% completed, an aqueous solution of $K_2[IrCl_6]$ was added to the system in an Ir amount corresponding to $5\times10^{-8}$ moles per mole of silver halide to be formed. Also, at a point where the addition of silver nitrate had been 90% completed, an aqueous solution of potassium iodide was added to the system in an I amount corresponding to 0.15 mol % per mole of silver halide to be formed while vigorously agitating the system. Moreover, in a period where the addition of silver nitrate had been 92% to 95% completed, an aqueous solution of $K_2[Ir(5\text{-methylthiazole})Cl_5]$ was added to the system in an Ir amount corresponding to $5\times10^{-7}$ moles per mole of silver halide to be formed. Also, in a period where the addition of silver nitrate had been 95% to 98% completed, an aqueous solution of $K_2[Ir(H_2O)Cl_5]$ was added to the system in an Ir amount corresponding to $5\times10^{-7}$ moles per mole of silver halide to be formed. After a desalting process at 40° C., 168 g of lime-processed gelatin were added to the system, and pH and pC of the resultant mixture was adjusted to 5.5 and 11.8, respectively. A silver iodobromochloride emulsion was obtained which had cubic grains having a sphere-equivalent diameter of 0.35 μm and a variation factor of 10%.

The emulsion was melted at 40° C., then sodium thiosulfonate was added to the emulsion in an amount of $2\times10^{-5}$ moles per mole of silver halide, and the emulsion was ripened to an optimum state at 60° C. employing sodium thiosulfate pentahydrate as a sulfur sensitizer and (S-2) as a gold sensitizer. After the temperature of the emulsion was lowered to 40° C., a sensitizing dye H, 1-phenyl-5-mercaptotetrazole, 1-(5-methylureidophenyl)-5-mercaptotetrazole, a compound I and potassium bromide were added to the emulsions in respective amounts of $2\times10^{-4}$ moles, $2\times10^{-4}$ moles, $8\times10^{-4}$ moles, $1\times10^{-3}$ moles and $7\times10^{-3}$ moles per mole of silver halide. The emulsion R-2 was thus obtained.

Sample Preparation

A corona discharge process was applied to a surface of a support formed by covering both surfaces of a paper with polyethylene resin, then a gelatin undercoat layer containing sodium dodecylbenzenesulfonate was formed on the processed surface of the support, and photographic layers of first to seventh layers were coated on the undercoat layer in succession to obtain a sample of a silver halide color photographic photosensitive material of a following layer configuration. A coating solution for each photographic layer was prepared in the following manner.

Preparation of First Layer Coating Solution 57 g of a yellow coupler (ExY), 7 g of a color image stabilizer (Cpd-1), 4 g of a color image stabilizer (Cpd-2), 7 g of a color image stabilizer (Cpd-3), and 2 g of a color image stabilizer (Cpd-8) were dissolved in 21 g of a solvent (Solv-1) and 80 ml of ethyl acetate, then an obtained solution was emulsified in 220 g of a 23.5 mass % aqueous solution of gelatin containing 4 g of sodium dodecylbenzesulfonate with a high-speed agitation emulsifier (dissolver) and water was added thereto to obtain 900 g of emulsion A.

The aforementioned emulsion A and the emulsion B-1 were mixed with each other to obtain a first layer coating solution of a formulation explained in the following. A coating amount of the emulsion is represented by a coating amount converted into a silver amount.

Preparation of Coating Solutions for Second to Seventh Layers

Coating solutions for the second to seventh layers were prepared in a method similar to that for the first layer coating solution. 1-oxy-3,5-dichloro-s-triazine sodium salt (H-1), (H-2) and (H-3) were employed as the gelatin hardening agent. Also, Ab-1, Ab-2, Ab-3 and Ab-4 were contained in each layer so as to respectively obtain total amounts of 15.0 mg/m², 60.0 mg/m², 5.0 mg/m² and 10.0 mg/m².

(H-1) Hardening agent

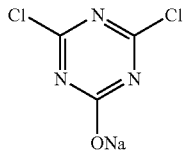

(H-2) Hardening agent

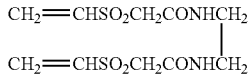

(H-3) Hardening agent

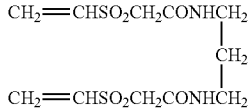

(Ab-1) Antiseptic

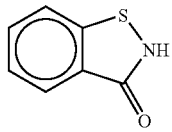

(Ab-2) Antiseptic

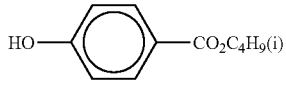

-continued (Ab-3) Antiseptic

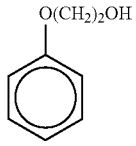

(Ab-4) Antiseptic

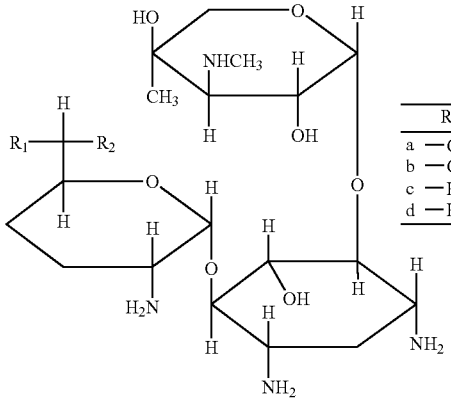

| | $R_1$ | $R_2$ |
|---|---|---|
| a | $-CH_3$ | $-NHCH_3$ |
| b | $-CH_3$ | $-NH_2$ |
| c | $-H$ | $-NH_2$ |
| d | $-H$ | $-NHCH_3$ |

A1:1:1:1 Mixture (Molar Ratio) of a, b, c and d

Also, 1-phenyl-5-mercaptotetrazole was contained in the green light-sensitive emulsion layer and in the red light-sensitive emulsion layer in respective amounts of $1.0\times10^{-3}$ moles and $5.9\times10^{-3}$ moles per mole of silver halide. Moreover, 1-phenyl-5-mercaptotetrazole was contained in the second, fourth and sixth layers in respective amounts of 0.2 $mg/m^2$, 0.2 $mg/m^2$, and 0.6 $mg/m^2$.

A methacrylic acid-butyl acrylate copolymer latex (mass ratio 1:1, average molecular weight 200,000-400,000) was contained in the red light-sensitive emulsion layer in an amount of 0.05 $g/m^2$. Also, disodium catechol-3,5-disulfonate was contained in the second, fourth and sixth layers in respective amounts of 6 $mg/m^2$, 6 $mg/m^2$, and 18 $mg/m^2$. Moreover, in order to prevent irradiation, the following dyes (parenthesized number indicates a coating amount) were contained.

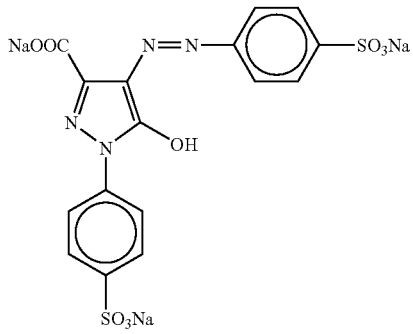

(2mg/$m^2$)

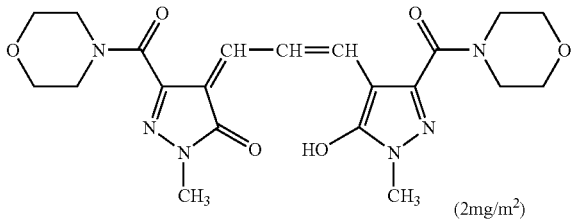

(2mg/$m^2$)

-continued

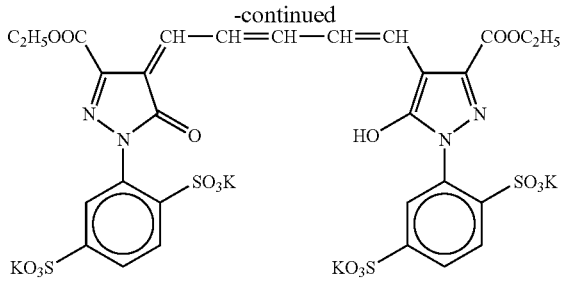

(3mg/$m^2$)

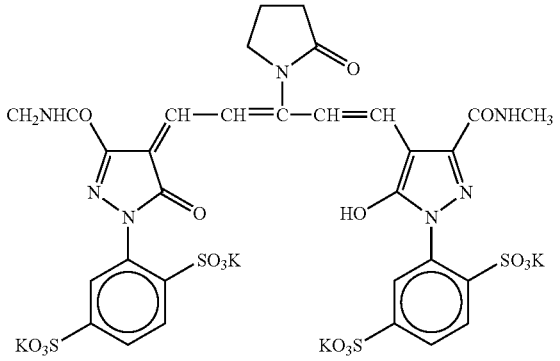

(7mg/$m^2$)

Layer Configuration

In the following, a composition of each layer is shown in which each number represents a coating amount ($g/m^2$) and silver halide emulsion is indicated by a coating amount converted into a silver amount.

Support

Paper laminated with polyethylene resin [Polyethylene resin at a side of the first layer contains a white pigment ($TiO_2$ content: 16 mass %, ZnO content: 4 mass %), a fluorescent whitening agent (4,4'-bis(5-methylbenzoxazolyl)stilbene content: 0.03 mass %), and a blue dye (ultramarine)]

| | |
|---|---|
| First layer (blue light-sensitive emulsion layer) | |
| Emulsion B-1 | 0.26 |
| Gelatin | 1.25 |
| Yellow coupler (ExY-1) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| Second layer (color mixing preventing layer) | |
| Gelatin | 0.99 |
| Color mixing preventing agent (Cpd-4) | 0.09 |
| Color image stabilizer (Cpd-5) | 0.018 |
| Color image stabilizer (Cpd-6) | 0.13 |
| Color image stabilizer (Cpd-7) | 0.01 |
| Solvent (Solv-1) | 0.06 |
| Solvent (Solv-2) | 0.22 |
| Third layer (green light-sensitive emulsion layer) | |
| Emulsion G-1 | 0.15 |
| Gelatin | 1.36 |
| Magenta coupler (ExM) | 0.15 |
| Ultraviolet absorbent (UV-A) | 0.14 |
| Color image stabilizer (Cpd-2) | 0.02 |
| Color image stabilizer (Cpd-4) | 0.002 |
| Color image stabilizer (Cpd-6) | 0.09 |

-continued

| | |
|---|---|
| Color image stabilizer (Cpd-8) | 0.02 |
| Color image stabilizer (Cpd-9) | 0.03 |
| Color image stabilizer (Cpd-10) | 0.01 |
| Color image stabilizer (Cpd-11) | 0.0001 |
| Solvent (Solv-3) | 0.11 |
| Solvent (Solv-4) | 0.22 |
| Solvent (Solv-5) | 0.20 |
| Fourth layer (color mixing preventing layer) | |
| Gelatin | 0.71 |
| Color mixing preventing agent (Cpd-4) | 0.06 |
| Color image stabilizer (Cpd-5) | 0.013 |
| Color image stabilizer (Cpd-6) | 0.10 |
| Color image stabilizer (Cpd-7) | 0.007 |
| Solvent (Solv-1) | 0.04 |
| Solvent (Solv-2) | 0.16 |
| Fifth layer (red light-sensitive emulsion layer) | |
| Emulsion R-1 | 0.13 |
| Gelatin | 1.11 |
| Cyan coupler (ExC-2) | 0.13 |
| Cyan coupler (ExC-3) | 0.03 |
| Color image stabilizer (Cpd-1) | 0.05 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.03 |
| Color image stabilizer (Cpd-17) | 0.09 |
| Color image stabilizer (Cpd-18) | 0.07 |
| Solvent (Solv-5) | 0.15 |
| Solvent (Solv-8) | 0.05 |
| Sixth layer (ultraviolet absorbing layer) | |
| Gelatin | 0.46 |
| Ultraviolet absorbent (UV-B) | 0.45 |
| Compound (S1-4) | 0.0015 |
| Solvent (Solv-7) | 0.25 |
| Seventh layer (protective layer) | |
| Gelatin | 1.00 |
| Acryl-modified polyvinyl alcohol copolymer (modification degree: 17%) | 0.04 |
| Liquid paraffin | 0.02 |
| Surfactant (Cpd-13) | 0.01 |

ExY-1 (Yellow Coupler)
A 70:30 Mixture (Molar Ratio) of

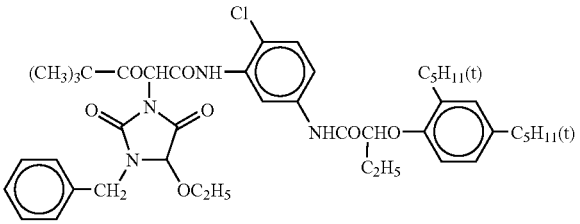

and

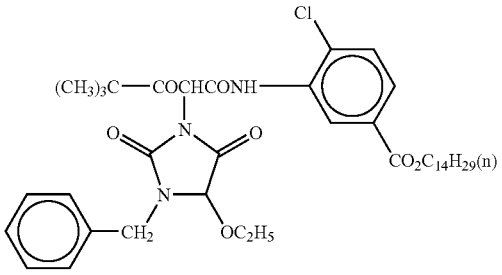

ExM (Magenta Coupler)
A 40:40:20 Mixture (Molar Ratio) of

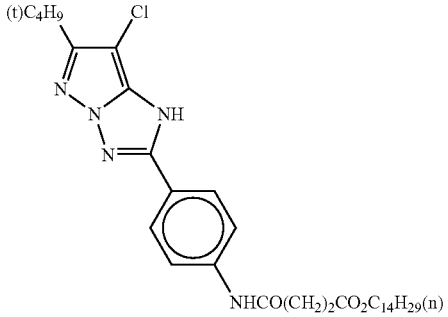

and

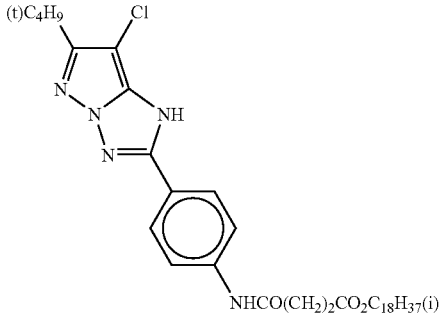

and

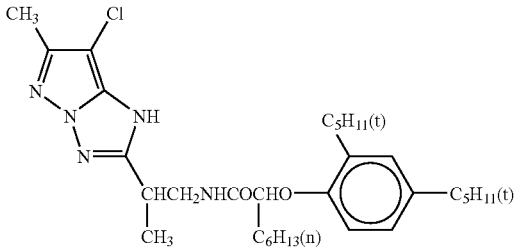

ExC-2 (Cyan Coupler)

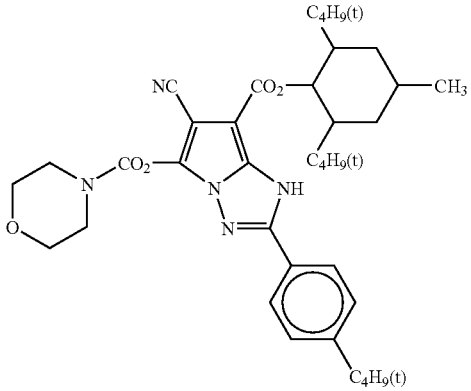

ExC-3 (Cyan Coupler)
A 50:25:25 Mixture (Molar Ratio) of

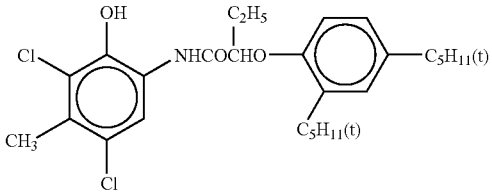

and

-continued
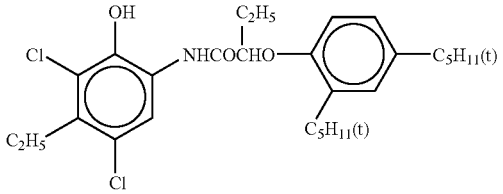
and
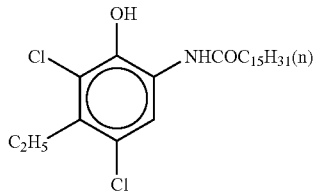
Cpd-1 (Color Image Stabilizer)
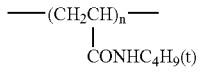
number-average molecular weight: 60,000
Cpd-2 (Color Image Stabilizer)
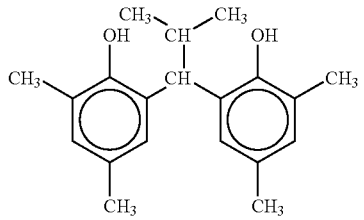
Cpd-3 (Color Image Stabilizer)
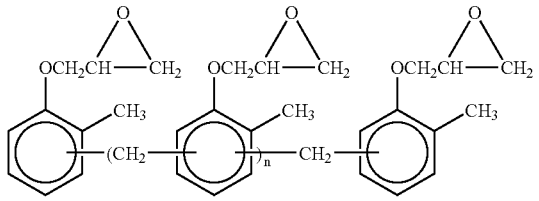
n=7–8 (average)
Cpd-4 (Color Mixing Preventing Agent)
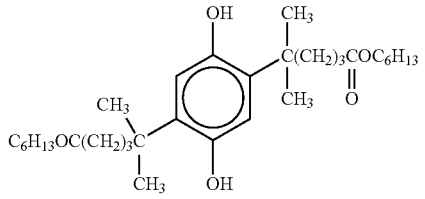
Cpd-5 (Color Image Stabilizer)
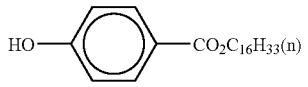
Cpd-6 (Color Image Stabilizer)
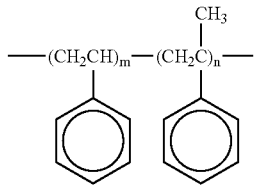
number-average molecular weight: 600 m/n=10/90
Cpd-7 (Color Image Stabilizer)
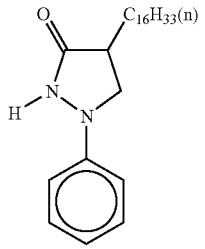
Cpd-8 (Color Image Stabilizer)
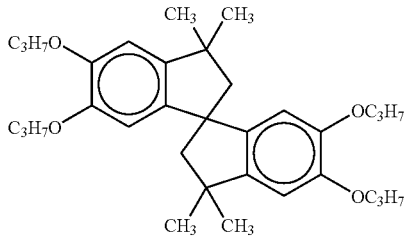
Cpd-9 (Color Image Stabilizer)
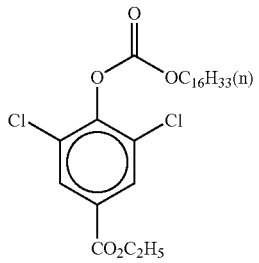

Cpd-10 (Color Image Stabilizer)
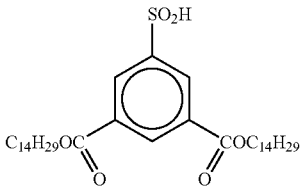
Cpd-11
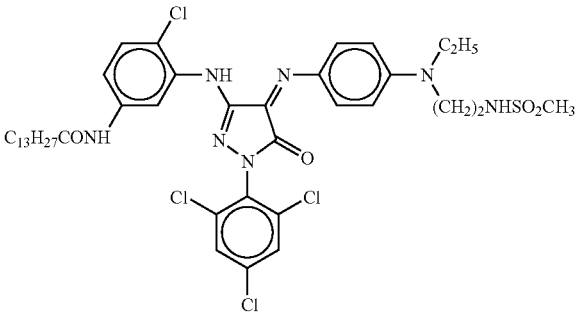
Cpd-3 (Surfactant)
A 7:3 Mixture (Molar Ratio) of
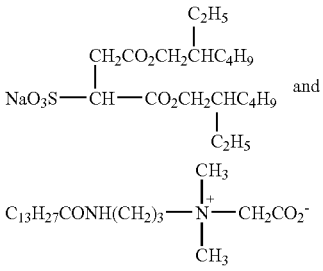
Cpd-14 Cpd-15
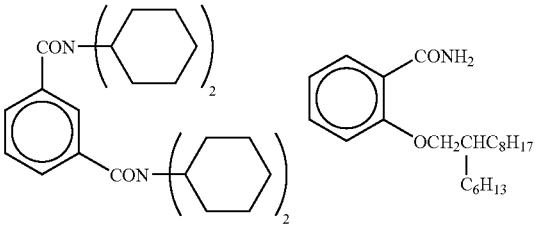
Cpd-16 Cpd-17
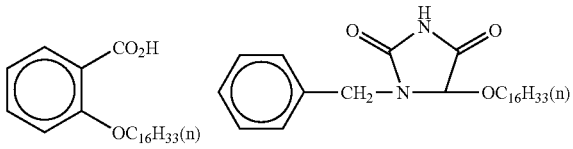
Cpd-18
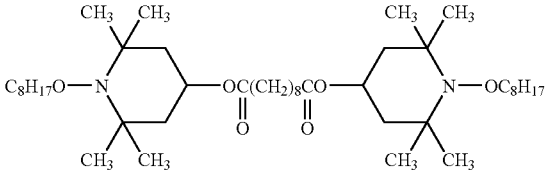
Cpd-19 (Color Mixing Preventing Agent)
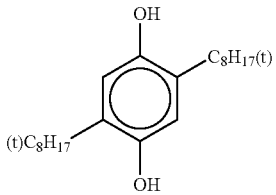
UV-1 (Ultraviolet Absorbent) UV-2 (Ultraviolet Absorbent)
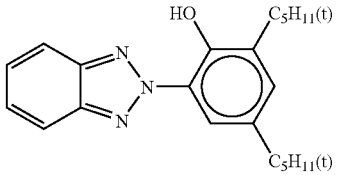
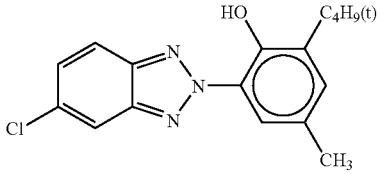
UV-3 (Ultraviolet Absorbent) UV-4 (Ultraviolet Absorbent)
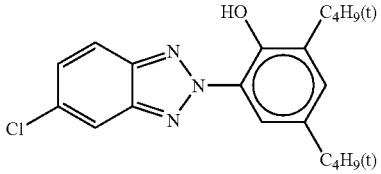
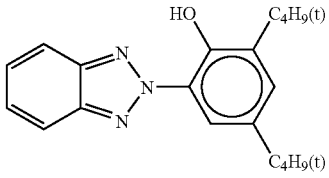

UV-5 (Ultraviolet Absorbent) UV-6 (Ultraviolet Absorbent)

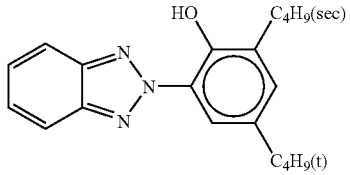

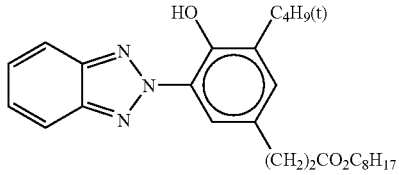

UV-7 (Ultraviolet Absorbent)

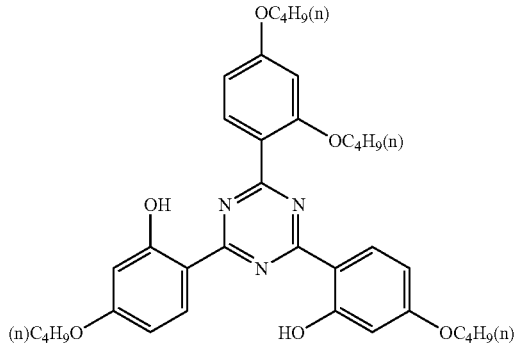

UV-A: A mixture of UV-1/UV-2/UV-3/UV-4=4/2/2/3 (mass ratio)

UV-B: A mixture of UV-1/UV-2/UV-3/UV-4/UV-5/UV-6=9/3/3/4/5/3 (mass ratio)

UV-C: A mixture of UV-2/UV-3/UV-6/UV-7=1/1/1/2 (mass ratio)

Solv-1

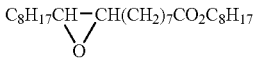

Solv-2

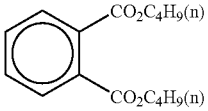

Solv-3

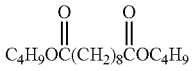

Solv-4

Solv-5

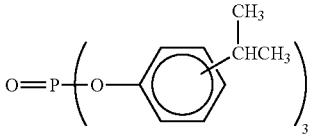

-continued

Solv-7

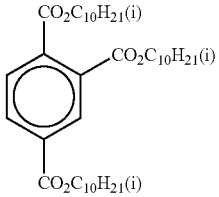

Solv-8

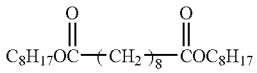

S1-4

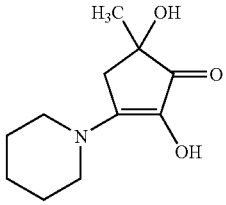

A sample 101 was thus prepared. Samples 102 to 104 were prepared in the same manner as in sample 101 except that the blue light-sensitive emulsion layer, the green light-sensitive emulsion layer and the red light-sensitive emulsion layer were changed, as shown in Table. 2.

A thinner sample 105 was prepared in the same manner as in sample 101 except that the photographic layers were changed as follows:

| | |
|---|---|
| First layer (blue light-sensitive emulsion layer) | |
| Emulsion B-1 | 0.14 |
| Gelatin | 0.75 |
| Yellow coupler (ExY-2) | 0.34 |
| Color image stabilizer (Cpd-1) | 0.04 |
| Color image stabilizer (Cpd-2) | 0.02 |
| Color image stabilizer (Cpd-3) | 0.04 |
| Color image stabilizer (Cpd-8) | 0.01 |
| Solvent (Solv-1) | 0.13 |
| Second layer (color mixing preventing layer) | |
| Gelatin | 0.60 |
| Color mixing preventing agent (Cpd-19) | 0.09 |
| Color image stabilizer (Cpd-5) | 0.007 |
| Color image stabilizer (Cpd-7) | 0.007 |
| Ultraviolet absorbent (UV-C) | 0.05 |
| Solvent (Solv-5) | 0.11 |
| Third layer (green light-sensitive emulsion layer) | |
| Emulsion G-1 | 0.14 |
| Gelatin | 0.73 |
| Magenta coupler (ExM) | 0.15 |
| Ultraviolet absorbent (UV-A) | 0.05 |
| Color image stabilizer (Cpd-2) | 0.02 |
| Color image stabilizer (Cpd-7) | 0.008 |
| Color image stabilizer (Cpd-8) | 0.07 |
| Color image stabilizer (Cpd-9) | 0.03 |
| Color image stabilizer (Cpd-10) | 0.009 |
| Color image stabilizer (Cpd-11) | 0.0001 |
| Solvent (Solv-3) | 0.06 |
| Solvent (Solv-4) | 0.11 |
| Solvent (Solv-5) | 0.06 |
| Fourth layer (color mixing preventing layer) | |
| Gelatin | 0.48 |
| Color mixing preventing agent (Cpd-4) | 0.07 |
| Color image stabilizer (Cpd-5) | 0.006 |
| Color image stabilizer (Cpd-7) | 0.006 |

-continued

| | |
|---|---|
| Ultraviolet absorbent (UV-C) | 0.04 |
| Solvent (Solv-5) | 0.09 |
| Fifth layer (red light-sensitive emulsion layer) | |
| Emulsion R-1 | 0.12 |
| Gelatin | 0.59 |
| Cyan coupler (ExC-2) | 0.13 |
| Cyan coupler (ExC-3) | 0.03 |
| Color image stabilizer (Cpd-7) | 0.01 |
| Color image stabilizer (Cpd-9) | 0.04 |
| Color image stabilizer (Cpd-15) | 0.19 |
| Color image stabilizer (Cpd-18) | 0.04 |
| Ultraviolet absorbent (UV-7) | 0.02 |
| Solvent (Solv-5) | 0.09 |
| Sixth layer (ultraviolet absorbing layer) | |
| Gelatin | 0.32 |
| Ultraviolet absorbent (UV-C) | 0.42 |
| Solvent (Solv-7) | 0.08 |
| Seventh layer (protective layer) | |
| Gelatin | 0.70 |
| Acryl-modified polyvinyl alcohol copolymer (modification degree: 17%) | 0.04 |
| Liquid paraffin | 0.01 |
| Surfactant (Cpd-13) | 0.01 |
| Polydimethylsiloxane | 0.01 |
| Silicon dioxide | 0.003 |

ExY-2

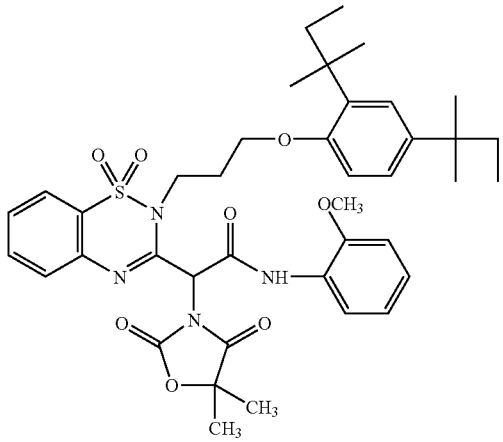

The sample 105 was thus prepared. Samples 106 to 108 were prepared in the same manner as in sample 105 except that the blue light-sensitive emulsion layer, the green light-sensitive emulsion layer and the red light-sensitive emulsion layer were changed, as shown in Table 2.

TABLE 2

| Sample | Total gelatin coat amount ($g/m^2$) | Total Ag coat amount ($g/m^2$) | Emulsion in blue-sensitive layer | Emulsion in green-sensitive layer | Emulsion in red-sensitive layer |
|---|---|---|---|---|---|
| 101 | 6.88 | 0.54 | B-1(0.75) | G-1(0.45) | R-1(0.45) |
| 102 | 6.88 | 0.54 | B-1(0.75) | G-2(0.35) | R-2(0.35) |
| 103 | 6.88 | 0.54 | B-2(0.55) | G-1(0.45) | R-1(0.45) |

TABLE 2-continued

| Sample | Total gelatin coat amount ($g/m^2$) | Total Ag coat amount ($g/m^2$) | Emulsion in blue-sensitive layer | Emulsion in green-sensitive layer | Emulsion in red-sensitive layer |
|---|---|---|---|---|---|
| 104 | 6.88 | 0.54 | B-2(0.55) | G-2(0.35) | R-2(0.35) |
| 105 | 4.17 | 0.40 | B-1(0.75) | G-1(0.45) | R-1(0.45) |
| 106 | 4.17 | 0.40 | B-1(0.75) | G-2(0.35) | R-2(0.35) |
| 107 | 4.17 | 0.40 | B-2(0.55) | G-1(0.45) | R-1(0.45) |
| 108 | 4.17 | 0.40 | B-2(0.55) | G-2(0.35) | R-2(0.35) |

Parenthesized figure for each emulsion indicates a sphere-equivalent diameter (μm).

Evaluation

Following experiments were conducted in order to evaluate the photographic characteristics of these samples.

High-illumination intensity gradation exposure of $10^{-6}$ seconds for gray color sensitometry was conducted on each coated sample with a high-illumination intensity exposure photometer (Model HIE, manufactured by Yamashita Dense Co.).

Each exposed sample was subjected to an ultra high speed processing of following color developing process.

[Processing]

Each sample of the aforementioned photosensitive material was processed into a roll having a width of 127 mm, then subjected to imagewise exposure through a negative film having an average density in an experimental processing apparatus, which was formed by modifying a Mini Laboratory Printer-processor PP350 (manufactured by Fuji Photo Film Co., Ltd.) in such a manner that the process time and the process temperature could be varied, and was subjected to a continuous processing (running test) until an amount of a color developer replenisher employed in the following process became 0.5 times as much as a capacity of a color developing tank.

| Process step | Temp | | |
|---|---|---|---|
| Color development | 45.0° C. | 15 sec | 45 mL |
| Bleach/fixing | 40.0° C. | 8 sec | 35 mL |
| Rinse (1) | | | |
| Rinse (2) | | | |
| Rinse (3) | **40.0C° C. | 8 sec | — |
| Rinse (4) | **38.0C° C. | 8 sec | 121 mL |
| Drying | 80.0° C. | 15 sec | |

Note *: replenishment amount per $m^2$ of photosensitive material

**: A rinse-cleaning system RC50D (manufactured by Fuji Photo Film Co., Ltd.) was used in the rinse (3) bath, and the rinse liquid was taken out from the rinse (3) bath and supplied to a reverse osmosis module (RC50D). The permeation water obtained therein was supplied to the rinse, and the concentrated liquid was returned to the rinse (3) bath. The amount of the permeation water to the reverse osmosis module was maintained at 50 to 300 mL/min by regulating a pump pressure, and the permeation water was circulated for 10 hours per day. The rinsing was conducted in a 4-tank counter current system from (1) to (4).

Compositions of the processing solutions were as follows.

| [Color developer] | [Tank solution] | [Replenisher] |
|---|---|---|
| Water | 800 mL | 600 mL |
| Fluorescent whitening agent (FL-1) | 5.0 g | 8.5 g |
| Triisopropanolamine | 8.8 g | 8.8 g |
| Sodium p-toluenesulfonate | 20.0 g | 20.0 g |
| Ethylenediamine tetraacetic acid | 4.0 g | 4.0 g |
| Sodium sulfite | 0.10 g | 0.50 g |
| Potassium chloride | 10.0 g | — |
| Sodium 4,5-dihydroxybenzene-1,3-disulfonate | 0.50 g | 0.50 g |
| Disodium-N,N-bis(sulfonateethyl) hydroxylamine | 8.5 g | 14.5 g |
| 4-amino-3-methyl-N-ethyl-N-(β-methanesulfonamidethyl)-aniline 3/2 sulfate monohydrate | 10.0 g | 22.0 g |
| Potassium carbonate | 26.3 g | 26.3 g |
| Water was added to the composition so that the total amount became | 1000 mL | 1000 mL |
| pH (25° C., adjusted with sulfuric acid and KOH) | 10.35 | 12.6 |

| [Bleach-fixing solution] | [Tank solution] | [Replenisher] |
|---|---|---|
| Water | 800 mL | 800 mL |
| Ammonium thiosulfate (750g/L) | 107 mL | 214 mL |
| Succinic acid | 29.5 g | 59.0 g |
| Iron (III) ammonium ethylenediamine tetraacetate | 47.0 g | 94.0 g |
| Ethylenediamine tetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water was added to the composition so that the total amount became | 1000 mL | 1000 mL |
| pH (25° C., adjusted with sulfuric acid and ammonia water) | 6.00 | 6.00 |

| [Rinse solution] | [Tank solution] | [Replenisher] |
|---|---|---|
| Sodium chloroisocyanurate | 0.02 g | 0.02 g |
| Deionized water (conductivity: 5 μS/cm or less) | 1000 mL | 1000 mL |
| pH (25° C.) | 6.5 | 6.5 |

FL-1

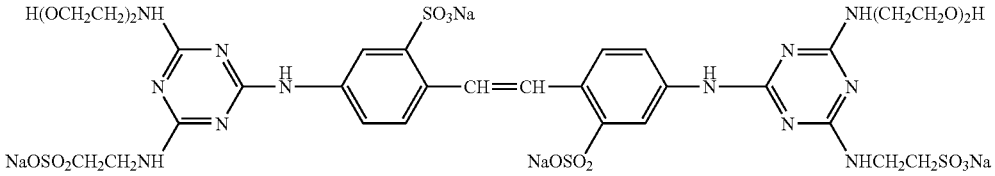

On each sample after processing, a developed yellow density was measured and a characteristic curve under a high illumination intensity exposure of $10^{-6}$ seconds was obtained. A gradation (γ) was determined from the inclination of a line connecting points of densities of 1.5 and 2.0. A higher value indicates a higher contrast and is preferable. Also, a change in the sensitivity (ΔS) resulting from a variation in the development time is represented, corresponding to a change between a color development time of 20 seconds and that of 15 seconds, by a logarithmic difference of reciprocals of exposure amounts which provide a color development density higher than the minimum color development density by 1.5. A smaller value is preferable as it indicates a higher stability. Obtained results are shown in Table 3.

TABLE 3

| | Example 1 ($10^{-6}$ sec exposure) | | Example 2 (laser scan exposure) | | |
|---|---|---|---|---|---|
| Sample | γ | ΔS | γ | ΔS | Remark |
| 101 | 1.85 | 0.10 | 1.85 | 0.11 | Comp. Ex. |
| 102 | 1.84 | 0.11 | 1.87 | 0.11 | Comp. Ex. |
| 103 | 1.88 | 0.09 | 1.90 | 0.09 | Comp. Ex. |
| 104 | 1.87 | 0.09 | 1.90 | 0.10 | Comp. Ex. |
| 105 | 1.92 | 0.07 | 1.94 | 0.08 | Comp. Ex. |
| 106 | 1.94 | 0.08 | 1.93 | 0.07 | Comp. Ex. |
| 107 | 2.28 | 0.05 | 2.33 | 0.04 | Present invention |
| 108 | 2.43 | 0.04 | 2.52 | 0.03 | Present invention |

As is apparent from the results shown in Table 3, the samples 107 and 108 of the invention showed a higher contrast in the yellow developed layer, and a smaller variation in the sensitivity against a change in the developing time, thus being superior in rapid processability.

Example 2

Image formation was conducted by laser scan exposure on the samples of the example 1.

A blue semiconductor laser having a wavelength of about 440 nm (announced by Nichia Kagaku Co. in March 2001, at 48th Applied Physics United Symposium), a green laser having a wavelength of about 530 nm, obtained from a semiconductor laser (oscillation wavelength: about 1060 nm) by a wavelength conversion with an $LiNbO_3$ SHG crystal having a waveguide-shaped inverted domain structure, and a red semiconductor laser having a wavelength of about 650 nm (Hitachi Type No. HL6501MG) were employed as the laser light sources. The laser beams of respective three colors were moved perpendicularly to a scanning direction by a polygon mirror to scan a sample in succession. A temperature-dependent fluctuation of the light amount of the semiconductor laser was suppressed by maintaining the temperature constant with a Peltier element. An effective beam diameter was 80 μm, a scanning pitch was 42.3 μm (600 dpi) and an average exposure time was $1.7\times10^{-7}$ seconds per pixel. This exposure method was used to provide a gradation exposure for gray color sensitometry.

After the exposure, each sample was subjected to the aforementioned color development. On each sample after processing, a developed yellow density was measured and a characteristic curve under a laser exposure was obtained. A gradation (γ) was determined from the inclination of a line connecting points of densities of 1.5 and 2.0. A higher value indicates a higher contrast and is preferable. Also, a change in the sensitivity (ΔS) resulting from a variation in the development time is represented, corresponding to a change between a color development time of 20 seconds and that of 15 seconds, by a logarithmic difference of reciprocals of exposure amounts which provide a color development density higher than the minimum color development density by 1.5. A smaller value is preferable as it indicates a higher stability. Obtained results are also shown in Table 3.

The samples 107 and 108 of the present invention showed a higher contrast in the yellow developed layer, and a smaller variation in the sensitivity against a change in the developing time. These effects were more conspicuous than in the high illumination intensity exposure in the example 1, and indicate that the photosensitive material of the present invention is suitable for image formation with the laser scan exposure.

Results of these examples and comparative examples indicate that the photosensitive material of the present invention provides a gradation of a particularly high contrast in a digital exposure such as laser scan exposure, and also provides a stable performance even under a fluctuation in the processing factors.

What is claimed is:

1. A silver halide color photographic photosensitive material comprising a support and photographic layers including a yellow color-developing blue light-sensitive silver halide emulsion layer, a magenta color-developing green light-sensitive silver halide emulsion layer, a cyan color-developing red light-sensitive silver halide emulsion layer and a non-photosensitive hydrophilic colloid layer, wherein a total silver coating amount in the photographic layers is within a range from 0.2 to 0.5 $g/m^2$ and the yellow color-developing blue light-sensitive silver halide emulsion layer includes a silver halide emulsion having silver halide grains which have a sphere-equivalent diameter of no more than 0.6 μm and a silver chloride content of at least 90 mol %.

2. A silver halide color photographic photosensitive material according to claim 1, wherein said magenta color-developing green light-sensitive silver halide emulsion layer and said cyan color-developing red light-sensitive silver halide emulsion layer include a silver halide emulsion having silver halide grains which have a sphere-equivalent diameter of no more than 0.4 μm and a silver chloride content of at least 90 mol %.

3. A silver halide color photographic photosensitive material according to claim 1, wherein the silver halide grains of the silver halide emulsion contained in said yellow color-developing blue light-sensitive silver halide emulsion layer have a silver bromide content within a range from 0.1 to 7 mol %.

4. A silver halide color photographic photosensitive material according to claim 1, wherein the silver halide grains of the silver halide emulsion contained in said yellow color-developing blue light-sensitive silver halide emulsion layer have a silver iodide content within a range from 0.02 to 1 mol %.

5. A silver halide color photographic photosensitive material according to claim 1, wherein the silver halide grains of the silver halide emulsion contained in said yellow color-developing blue light-sensitive silver halide emulsion layer have a silver bromide content within a range from 0.1 to 7 mol %, and a silver iodide content within a range from 0.02 to 1 mol %.

6. A silver halide color photographic photosensitive material according to claim 1, wherein the silver halide grains of the silver halide emulsion contained in said yellow color-developing blue light-sensitive silver halide emulsion layer are cubic grains or tetradecahedral grains.

7. A silver halide color photographic photosensitive material according to claim 1, wherein the silver halide grains of the silver halide emulsion contained in said yellow color-developing blue light-sensitive silver halide emulsion layer include a 6-coordination complex including Ir as a central metal and Cl, Br or I as a ligand.

8. A silver halide color photographic photosensitive material according to claim 1, wherein the silver halide grains of the silver halide emulsion contained in said yellow color-developing blue light-sensitive silver halide emulsion layer include a 6-coordination complex including Ir as a central metal and at least one ligand other than halogen and cyano.

9. An image forming method comprising the steps of imagewise exposing the silver halide color photographic photosensitive material according to claim 1 to a coherent light of a blue laser having a light emission wavelength range of 420 to 460 nm and then subjecting the photosensitive material to a color development process.

10. An image forming method comprising the steps of imagewise exposing the silver halide color photographic photosensitive material according to claim 1 and then subjecting the photosensitive material to a color development process with a color developing time of 20 seconds or less.

11. An image forming method comprising the steps of imagewise exposing the silver halide color photographic photosensitive material according to claim 1 to coherent light of a blue laser having a light emission wavelength within a range of 420 to 460 nm and then subjecting the photosensitive material to a color development process with a color developing time of 20 seconds or less.

* * * * *